US007607750B2

(12) United States Patent
Igarashi et al.

(10) Patent No.: US 7,607,750 B2
(45) Date of Patent: Oct. 27, 2009

(54) PUMP CONTROL MECHANISM, PRINTER INCORPORATING THE SAME, AND PUMP CONTROL METHOD

(75) Inventors: Hitoshi Igarashi, Nagano (JP); Kaoru Koyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 441 days.

(21) Appl. No.: 11/237,992

(22) Filed: Sep. 27, 2005

(65) Prior Publication Data

US 2006/0071965 A1 Apr. 6, 2006

(30) Foreign Application Priority Data

Sep. 27, 2004 (JP) ..... 2004-278991
Sep. 27, 2004 (JP) ..... 2004-278992
Sep. 29, 2004 (JP) ..... 2004-283633
Sep. 29, 2004 (JP) ..... 2004-283634

(51) Int. Cl.
*B41J 29/393* (2006.01)
*F04B 49/10* (2006.01)
*F04B 43/00* (2006.01)

(52) U.S. Cl. ..... 347/19; 417/32; 417/412

(58) Field of Classification Search ..... 347/19; 417/32, 412, 472, 489; 222/621, 209
See application file for complete search history.

(56) References Cited

U.S. PATENT DOCUMENTS 4,352,636 A * 10/1982 Patterson et al. ..... 417/22
6,412,916 B1 * 7/2002 Okano et al. ..... 347/55
6,612,682 B1 9/2003 Saito
6,776,467 B2 8/2004 Yamazaki et al.
7,131,720 B2 11/2006 Mizuno et al.
7,240,999 B2 * 7/2007 Kumagai et al. ..... 347/85
2004/0047737 A1 * 3/2004 Nose et al. ..... 417/44.1
2004/0250838 A1 * 12/2004 Kim et al. ..... 134/25.4

FOREIGN PATENT DOCUMENTS

JP 6-320732 11/1994
JP 2001-58420 3/2001
JP 2002-510252 4/2002
JP 2002-137383 5/2002
JP 2003-211644 7/2003
JP 2004-237502 8/2004

* cited by examiner

*Primary Examiner*—Julian D Huffman
*Assistant Examiner*—Jason S Uhlenhake
(74) *Attorney, Agent, or Firm*—Nutter McClennen & Fish LLP; John J. Penny, Jr.

(57) ABSTRACT

A pump member is cyclically moved to apply an air pressure to a liquid supply source to thereby supply liquid stored therein to a reservoir member. A driving source is driven in accordance with control information to move the pump member. A position sensor senses a position of the pump member. A first storage stores target information indicative of a target driving speed of the driving source. A first calculator obtains drive information indicative of an actual driving speed of the driving source based on the sensed position of the pump member. A second calculator obtains a difference between the target driving speed and the actual driving speed, and obtains correction information for reducing the difference. A corrector corrects the control information with the correction information.

16 Claims, 15 Drawing Sheets

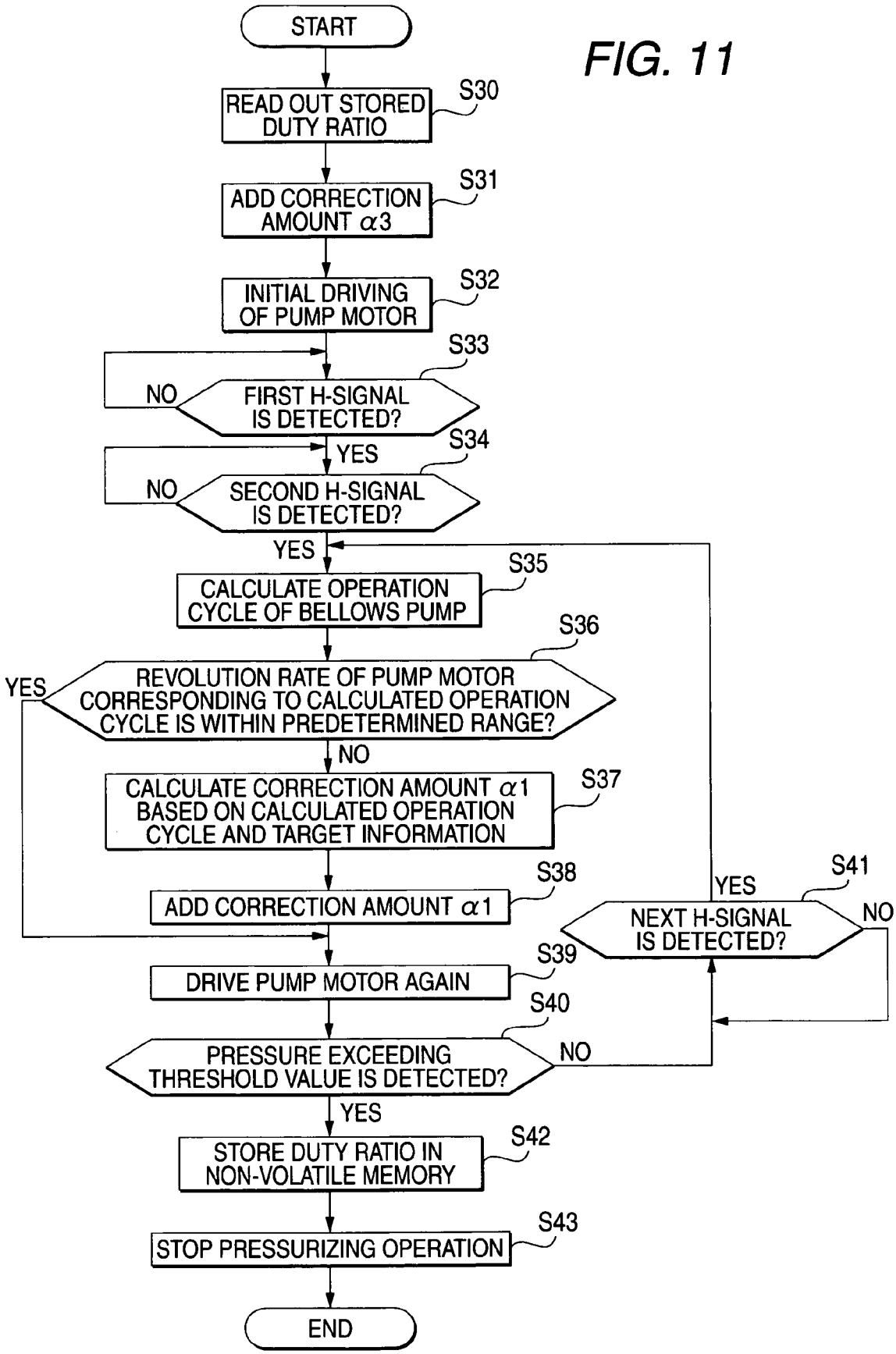
FIG. 11
START
READ OUT STORED DUTY RATIO
S30
ADD CORRECTION AMOUNT α3
S31
INITIAL DRIVING OF PUMP MOTOR
S32
S33
FIRST H-SIGNAL IS DETECTED?
NO
YES
S34
SECOND H-SIGNAL IS DETECTED?
NO
YES
CALCULATE OPERATION CYCLE OF BELLOWS PUMP
S35
S36
REVOLUTION RATE OF PUMP MOTOR CORRESPONDING TO CALCULATED OPERATION CYCLE IS WITHIN PREDETERMINED RANGE?
YES
NO
CALCULATE CORRECTION AMOUNT α1 BASED ON CALCULATED OPERATION CYCLE AND TARGET INFORMATION
S37
ADD CORRECTION AMOUNT α1
S38
S41
NEXT H-SIGNAL IS DETECTED?
YES
NO
DRIVE PUMP MOTOR AGAIN
S39
S40
PRESSURE EXCEEDING THRESHOLD VALUE IS DETECTED?
NO
YES
STORE DUTY RATIO IN NON-VOLATILE MEMORY
S42
STOP PRESSURIZING OPERATION
S43
END

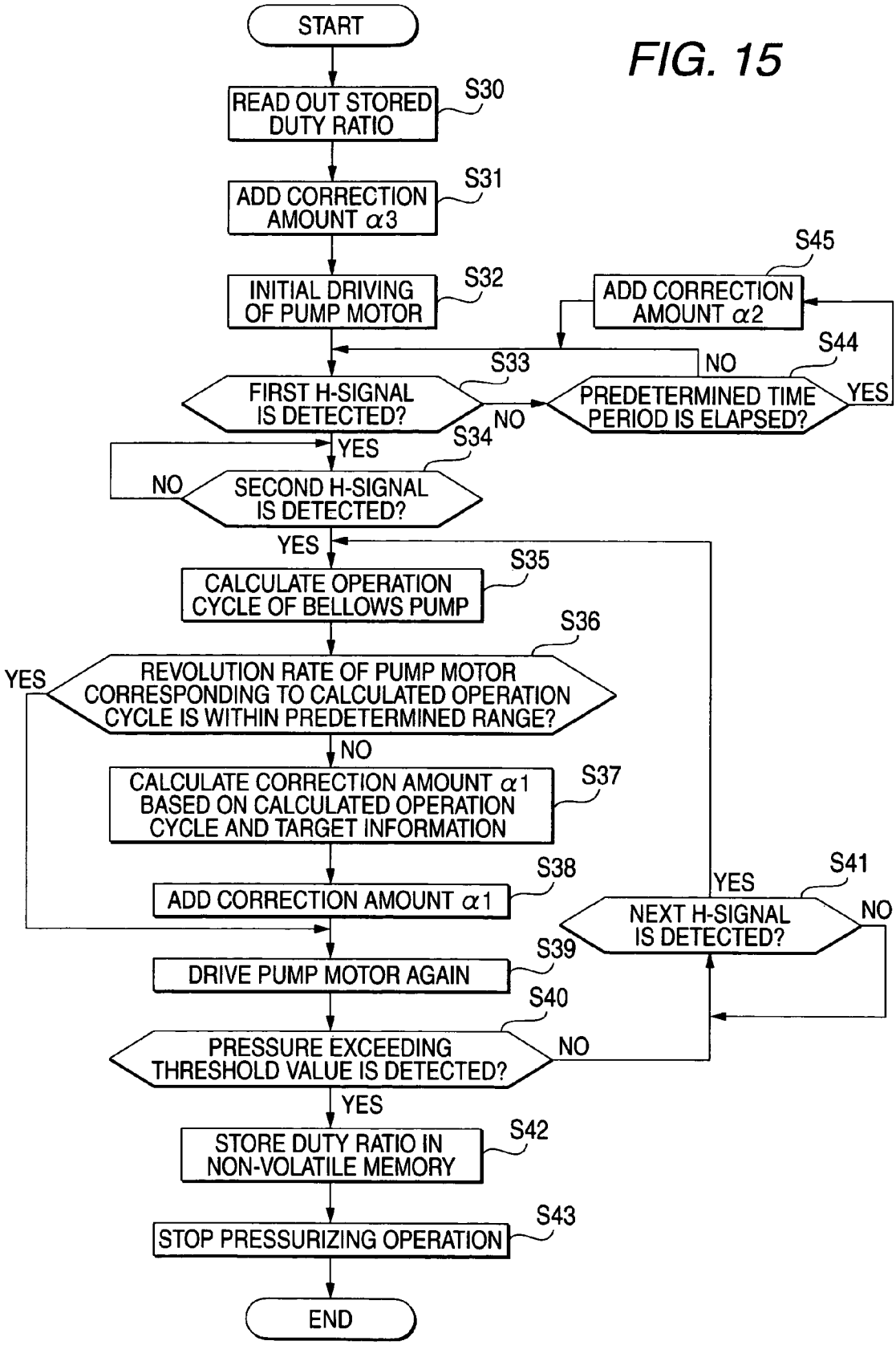
FIG. 15
START
READ OUT STORED DUTY RATIO
S30
ADD CORRECTION AMOUNT α3
S31
INITIAL DRIVING OF PUMP MOTOR
S32
ADD CORRECTION AMOUNT α2
S45
FIRST H-SIGNAL IS DETECTED?
S33
NO
PREDETERMINED TIME PERIOD IS ELAPSED?
S44
YES
NO
YES
SECOND H-SIGNAL IS DETECTED?
S34
NO
YES
CALCULATE OPERATION CYCLE OF BELLOWS PUMP
S35
REVOLUTION RATE OF PUMP MOTOR CORRESPONDING TO CALCULATED OPERATION CYCLE IS WITHIN PREDETERMINED RANGE?
S36
YES
NO
CALCULATE CORRECTION AMOUNT α1 BASED ON CALCULATED OPERATION CYCLE AND TARGET INFORMATION
S37
ADD CORRECTION AMOUNT α1
S38
NEXT H-SIGNAL IS DETECTED?
S41
YES
NO
DRIVE PUMP MOTOR AGAIN
S39
PRESSURE EXCEEDING THRESHOLD VALUE IS DETECTED?
S40
NO
YES
STORE DUTY RATIO IN NON-VOLATILE MEMORY
S42
STOP PRESSURIZING OPERATION
S43
END

PUMP CONTROL MECHANISM, PRINTER INCORPORATING THE SAME, AND PUMP CONTROL METHOD

BACKGROUND OF THE INVENTION

The present invention relates to a pump control mechanism, a printer incorporating the same, and a pump control method.

In a majority of relatively low performance type printers, a cartridge for storing ink is mounted on a carriage. On the other hand, in some high performance type printers, the cartridge is not mounted on the carriage but on the housing of the printer. In printers of this type, even when the ink residual amount varies, a fluctuation can be suppressed in the weight of the carriage. Thus, the printers of this type achieve precise control of the motion of the carriage.

In the printers of the above-mentioned type, a liquid container is mounted on the carriage. Then, a cartridge is connected to the liquid container via a liquid pipe, so that ink can be supplied from the cartridge to the liquid container. Further, one end of an air pipe is connected to the cartridge. The other end of the air pipe is connected to a bellows pump in a pump unit. When the bellows pump is driven, air is supplied into the cartridge via the air pipe. Then, by this air pressure, the ink can be supplied from the cartridge to the liquid container via the liquid pipe.

An example of a printer using such air pressure is disclosed in Japanese Patent Publication No. 2002-510252A. Specifically, the printer comprises: a reciprocating member for performing reciprocating motion and thereby compressing air; a pump motor for causing the reciprocating member to perform the reciprocating motion; and an electric power supplying section for supplying electric power to the pump motor until the pressure of the liquid container reaches a predetermined pressure.

Meanwhile, when the bellows pump is driven by the pump motor, the noise generated from noise sources such as the pump motor and a conversion mechanism becomes problematic. In the operation sound generated from the printer, this kind of noise is remarkably loud. Thus, its reduction is an issue.

In particular, when the bellows pump is expanded and contracted, the external load acting on the pump motor varies according to a change in the internal pressure of the bellows pump, so that the revolution rate of the pump motor fluctuates depending on the change. Thus, the noise generated from the noise source also fluctuates according to the fluctuation of the revolution rate. Meanwhile, when the noise fluctuates according to the revolution rate, a problem arises that the noise is felt stronger to the ear in comparison with the case that sound at a constant level is generated stationary from a noise source. That is, when noise of the same level is generated, noise having a fluctuated magnitude is felt noisier than noise generated stationary.

This problem of noise arises at each time that the pump motor operates during the usage of the printer. Accordingly, a problem occurs wherein the problem of noise continues during the usage of the printer. Thus, it is desired to achieve quiet operation at least in a steady state that the initial operation of the printer has been completed. Here, in the control of the above-mentioned pump motor, in a case where a sensor such as a rotary encoder capable of detecting the revolution rate is installed so that the revolution rate of the pump motor is controlled using a feedback signal from the sensor, the noise can be reduced. Nevertheless, the installation of the rotary encoder or the like causes a problem such as a cost increase.

Nevertheless, even if the noise reduction were possible merely by the detection of the signals from the position sensor and the pressure sensor, in a case where a fault occurs in the position detection sensor or the pressure sensor, the problem of noise is not solved. That is, the occurrence of a fault in the position detection sensor or the pressure sensor causes a situation not merely that appropriate control of the revolution rate of the pump motor cannot be performed but also that the revolution rate increases in contrast to the intention. Further, the pump motor continues to revolve indefinitely, and thereby causes a problem that the problem of noise continues during the continuation of the revolution.

SUMMARY OF THE INVENTION

It is therefore an object of the invention to provide a pump control mechanism in which noise can be reduced during the driving of a pump unit having completed initial operation.

It is also an object of the invention to provide a pump control mechanism in which the fluctuation of noise within one cycle can be reduced so that quiet operation can be achieved.

It is also an object of the invention to provide a pump control mechanism in which the driving of a pump unit can be stopped appropriately even when a fault occurs in a position detection sensor or a pressure sensor.

It is also an object of the invention to provide a printer incorporating such a pump control mechanism and a pump control method.

According to the invention, there is provided a pump control mechanism, comprising:

- a pump unit, comprising:
  - a pump member, adapted to be cyclically moved to apply an air pressure to a liquid supply source to thereby supply liquid stored therein to a reservoir member; and
  - a driving source, configured to be driven in accordance with control information to move the pump member;
- a position sensor, sensing a position of the pump member;
- a first storage, storing target information indicative of a target driving speed of the driving source;
- a first calculator, operable to obtain drive information indicative of an actual driving speed of the driving source based on the sensed position of the pump member;
- a second calculator, operable to obtain a difference between the target driving speed and the actual driving speed, and obtain first correction information for reducing the difference; and
- a corrector, operable to correct the control information with the first correction information.

The driving source may be driven by a voltage signal having a pulse waveform. The control information may include a duty ratio of the—voltage signal in connection with a pulse width modulation technique, and the first correction information may include data for varying the duty ratio.

The pump member may be a bellows pump, and the position sensor detects a position that the bellows pump is fully expanded.

The pump control mechanism may further comprise: a pressure sensor, sensing the air pressure; and a controller, operable to activate or deactivate the driving source in accordance with the air pressure sensed by the pressure sensor.

The pump member may be a bellows pump, and the controller may deactivate the driving source so that the pump member is stopped at a position that the bellows pump is fully expanded.

The corrector may correct the control information after the pump member is actuated for two cycles.

The pump driving mechanism may further comprise a timer, counting a time period until the position sensor detects that the pump member is moved to a prescribed position. The corrector may correct the control information so as to increase the duty ratio when the time period reaches a prescribed value.

The pump control mechanism may further comprise: a duty ratio monitor, monitoring the duty ratio of the voltage signal; and a controller, operable to deactivate the driving source for a prescribed time period when the monitored duty ratio exceeds a prescribed value.

The pump control mechanism may further comprise a second storage storing the corrected control information. The driving source may be driven based on the corrected control information stored in the second storage when the driving source is reactivated.

The corrector may correct the corrected control information with second correction information when the driving source is reactivated.

The second correction information may include data for decreasing the duty ratio.

The pump control mechanism may further comprise a liquid amount monitor, monitoring a residual amount of the liquid stored in the liquid supply source. The first correction information may be modified in accordance with the monitored residual amount.

The control information may include a control table in which data for increasing or decreasing a driving force of the driving source from a reference value in accordance with load acting on the driving source is set for each of a plurality of unit time periods.

The control table may include data for increasing or decreasing a duty ratio of the voltage signal, in connection with a pulse width modulation technique, from a reference value for each of the unit time periods.

A total length of the unit time periods may be shorter than one cycle of the movement of the pump member. Here, the driving source may be driven with the data of a final one of the unit time periods until the control information is corrected with the first correction information in a next cycle of the movement of the pump member.

A total length of the unit time periods may be longer than one cycle of the movement of the pump member; and the application of the control information to the driving source in one cycle of the movement of the pump member is interrupted when the position sensor detects a prescribed position of the pump member for a next cycle.

The position sensor may generate a detection signal while the pump member is placed in a prescribed position. The second calculator may obtain the first correction information based on a time period during which the detection signal is generated.

According to the invention, there is provided a printer incorporating the above pump control mechanism and comprising: a carriage, adapted to move in a prescribed direction; and a recording head, mounted on the carriage and adapted to perform printing on a printing medium. Here, the reservoir is provided on the carriage. The liquid is ink, and the liquid supply source is a replaceable cartridge storing the ink.

According to the invention, there is also provided a pump control method, comprising:

providing a pump unit, comprising:

a pump member, adapted to be cyclically moved to apply an air pressure to a liquid supply source to thereby supply liquid stored therein to a reservoir member; and a driving source, configured to be driven in accordance with control information to move the pump member;

sensing a position of the pump member; storing target information indicative of a target driving speed of the driving source in a first storage;

obtaining drive information indicative of an actual driving speed of the driving source based on the sensed position;

obtaining a difference between the target driving speed and the actual driving speed;

obtaining first correction information for reducing the difference; and correcting the control information with the first correction information.

The pump control method may further comprise: storing the corrected control information in a second storage; and driving the driving source based on the corrected control information stored in the second storage when the driving source is reactivated.

The pump control method may further comprise correcting the corrected control information with second correction information when the driving source is reactivated.

The pump control method may further comprise: monitoring a residual amount of the liquid stored in the liquid supply source; and modifying the first correction information in accordance with the monitored residual amount.

The pump control method may further comprise providing a control table in which data for increasing or decreasing a driving force of the driving source from a reference value in accordance with load acting on the driving source is set for each of a plurality of unit time periods, as the control information.

According to the invention, there is also provided a pump control mechanism, comprising:

a pump unit, comprising:

a pump member, adapted to be cyclically moved to apply an air pressure to a liquid supply source to thereby supply liquid stored therein to a reservoir member; and a driving source, operable to move the pump member;

a position sensor, generating a detection signal when the pump member is placed in a prescribed position; and a controller, operable to judge whether a prescribed condition is satisfied when the detection signal is not generated, and operable to deactivate the driving source when it is judged that the prescribed condition is satisfied.

The prescribed condition may include a first condition that a first prescribed time period is elapsed.

The prescribed condition may include a second condition that a second prescribed time period which is shorter than the first time period. The controller may be operable to increase a driving speed of the driving source when it is judged that the second condition is satisfied.

According to the invention, there is also provided a pump control mechanism, comprising:

a pump unit, comprising:

a pump member, adapted to be cyclically moved to apply an air pressure to a liquid supply source to thereby supply liquid stored therein to a reservoir member; and a driving source, operable to move the pump member;

a position sensor, generating a first detection signal when the pump member is placed in a prescribed position;

a pressure sensor, generating a second detection signal when the air pressure exceeds a prescribed value;

a controller, operable to judge whether a prescribed condition is satisfied when the second detection signal is not generated, and operable to deactivate the driving source when it is judged that the prescribed condition is satisfied, wherein the prescribed condition includes a first condition that the generated number of the first detection signal exceeds a prescribed value.

The prescribed condition may include a second condition that the second detection signal is not generated for a prescribed time period.

According to the invention, there is also provided a pump control mechanism, comprising:

a pump unit, comprising:

a pump member, adapted to be cyclically moved to apply an air pressure to a liquid supply source to thereby supply liquid stored therein to a reservoir member; and a driving source, operable to move the pump member;

a pressure sensor, generating a detection signal when the air pressure exceeds a prescribed value;

a controller, operable to judge whether a prescribed condition is satisfied when the second detection signal is not generated, and operable to deactivate the driving source when it is judged that the prescribed condition is satisfied, wherein the prescribed condition is that the detection signal is not generated for a prescribed time period.

The pump control mechanism may further comprise an error information generator operable to generate error information indicating that an error is occurred in the position sensor when the controller judges that the prescribed condition is satisfied.

The pump control mechanism may further comprise an error information generator, operable to generate error information indicating that an error is occurred in the pressure sensor when the controller judges that the prescribed condition is satisfied.

The pump control mechanism may further comprise a storage operable to store the error information.

The pump control mechanism may further comprise a display operable to display the error information.

The pump member may be a bellows pump, and the prescribed position is a position that the bellows pump is fully expanded.

The pump member may be a bellows pump, and the controller may deactivate the driving source so that the pump member is stopped at a position that the bellows pump is fully expanded.

According to the invention, there is also provided a printer incorporating the above pump control mechanism and comprising: a carriage, adapted to move in a prescribed direction; and a recording head, mounted on the carriage and adapted to perform printing on a printing medium. Here, the reservoir is provided on the carriage. The liquid is ink, and the liquid supply source is a replaceable cartridge storing the ink.

According to the invention, there is also provided a pump control method, comprising:

providing a pump unit, comprising:

a pump member, adapted to be cyclically moved to apply an air pressure to a liquid supply source to thereby supply liquid stored therein to a reservoir member; and a driving source, operable to move the pump member;

generating a detection signal when the pump member is placed in a prescribed position;

judging whether a prescribed condition is satisfied when the detection signal is not generated; and deactivating the driving source when it is judged that the prescribed condition is satisfied.

According to the invention, there is also provided a pump control method, comprising:

providing a pump unit, comprising:

a pump member, adapted to be cyclically moved to apply an air pressure to a liquid supply source to thereby supply liquid stored therein to a reservoir member; and a driving source, operable to move the pump member;

generating a first detection signal when the pump member is placed in a prescribed position;

generating a second detection signal when the air pressure exceeds a prescribed value;

judging whether a prescribed condition is satisfied when the second detection signal is not generated; and deactivating the driving source when it is judged that the prescribed condition is satisfied, wherein the prescribed condition includes a first condition that the generated number of the first detection signal exceeds a prescribed value.

According to the invention, there is also provided a pump control method, comprising:

providing a pump unit comprising:

a pump member, adapted to be cyclically moved to apply an air pressure to a liquid supply source to thereby supply liquid stored therein to a reservoir member; and a driving source, operable to move the pump member;

generating a detection signal when the air pressure exceeds a prescribed value;

judging whether a prescribed condition is satisfied when the second detection signal is not generated; and deactivating the driving source when it is judged that the prescribed condition is satisfied, wherein the prescribed condition is that the detection signal is not generated for a prescribed time period.

BRIEF DESCRIPTION OF THE DRAWINGS

The above objects and advantages of the present invention will become more apparent by describing in detail preferred exemplary embodiments thereof with reference to the accompanying drawings, wherein:

FIG. 11 is a flow chart showing how to control the pump unit when the pump motor is driven after an interval;

FIG. 15 is a flow chart showing how to control the pump unit of the second embodiment when the pump motor is driven after an interval;

DETAILED DESCRIPTION OF THE EMBODIMENTS

Embodiments of the invention will be described with reference to the accompanying drawings. A printer 10 according to a first embodiment encompasses an ink jet printer capable of ejecting ink to perform printing with any types of ejecting method.

In the following description, the lower side indicates an installation surface 1 side on which the printer 10 is installed. The upper side indicates a side departing from the installation surface 1. Further, the direction in which a carriage 40 described later travels is referred to as the primary scanning direction. The direction which is perpendicular to the primary scanning direction and in which a printing medium 12 such as paper is conveyed is referred to as the secondary scanning direction. The side from which the printing medium 12 is supplied (the upstream of medium feeding) is referred to as a rear side. The side to which the printing medium 12 is ejected (the downstream of medium feeding) is referred to as a front side.

Figure 6:
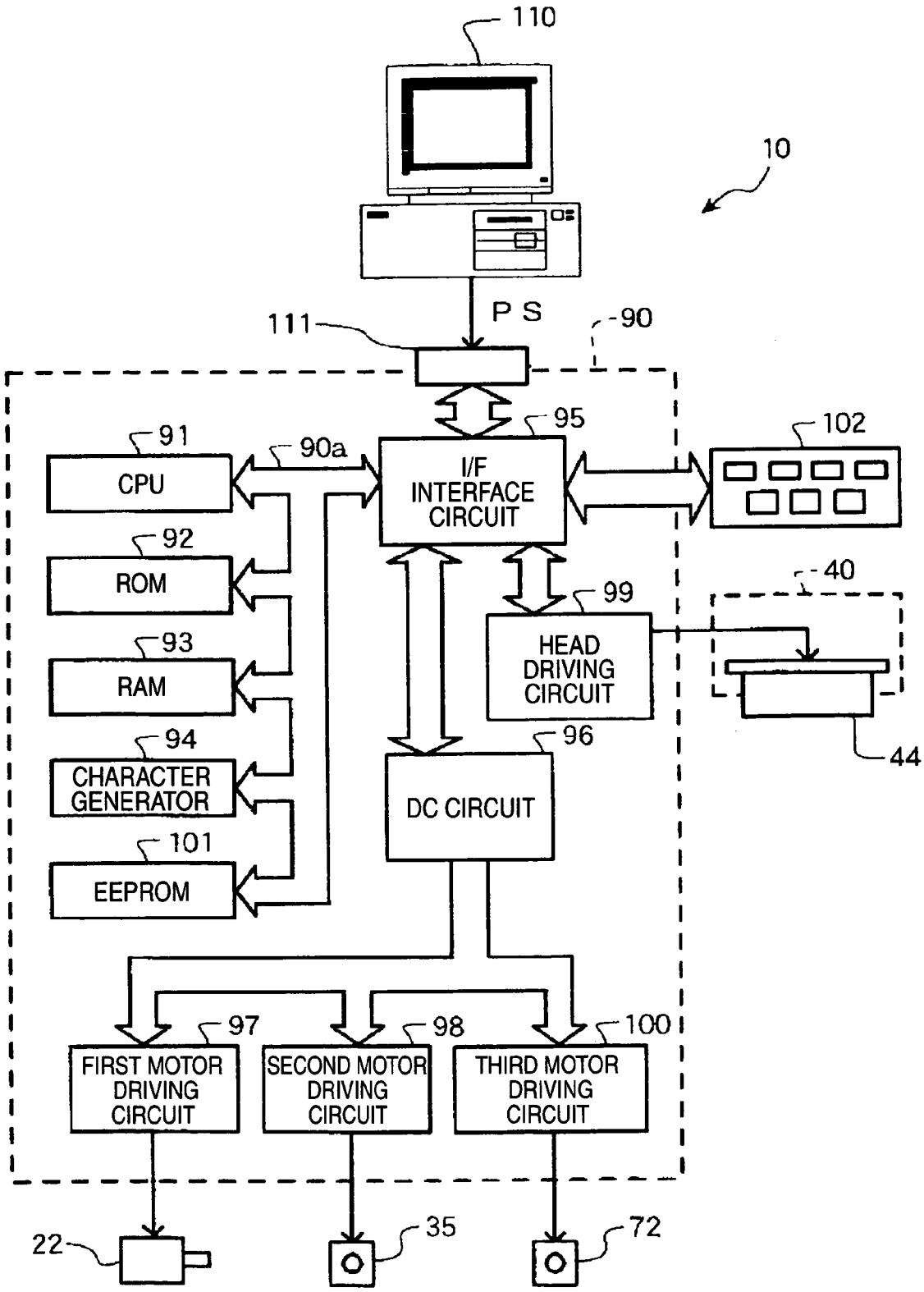
FIG. 6 is a block diagram showing a circuit configuration of the printer of FIG. 1.

The printer 10 comprises a chassis 11 in contact with the installation surface 1, while various units are mounted on the chassis 11. These various units include: a medium transporting mechanism 20 for transporting the printing medium 12 by a medium feeding motor 22; a carriage mechanism 30 for causing the carriage 40 to perform reciprocating motion in the axis direction of the medium feeding roller by a carriage motor 35; cartridge mounting sections 60 for mounting cartridges 62 for storing ink; and a pump unit 70 for supplying air into the cartridges 62 and thereby pressurizing them. In addition, a controller 90 is provided as shown in FIG. 2 and FIG. 6.

Figure 2:
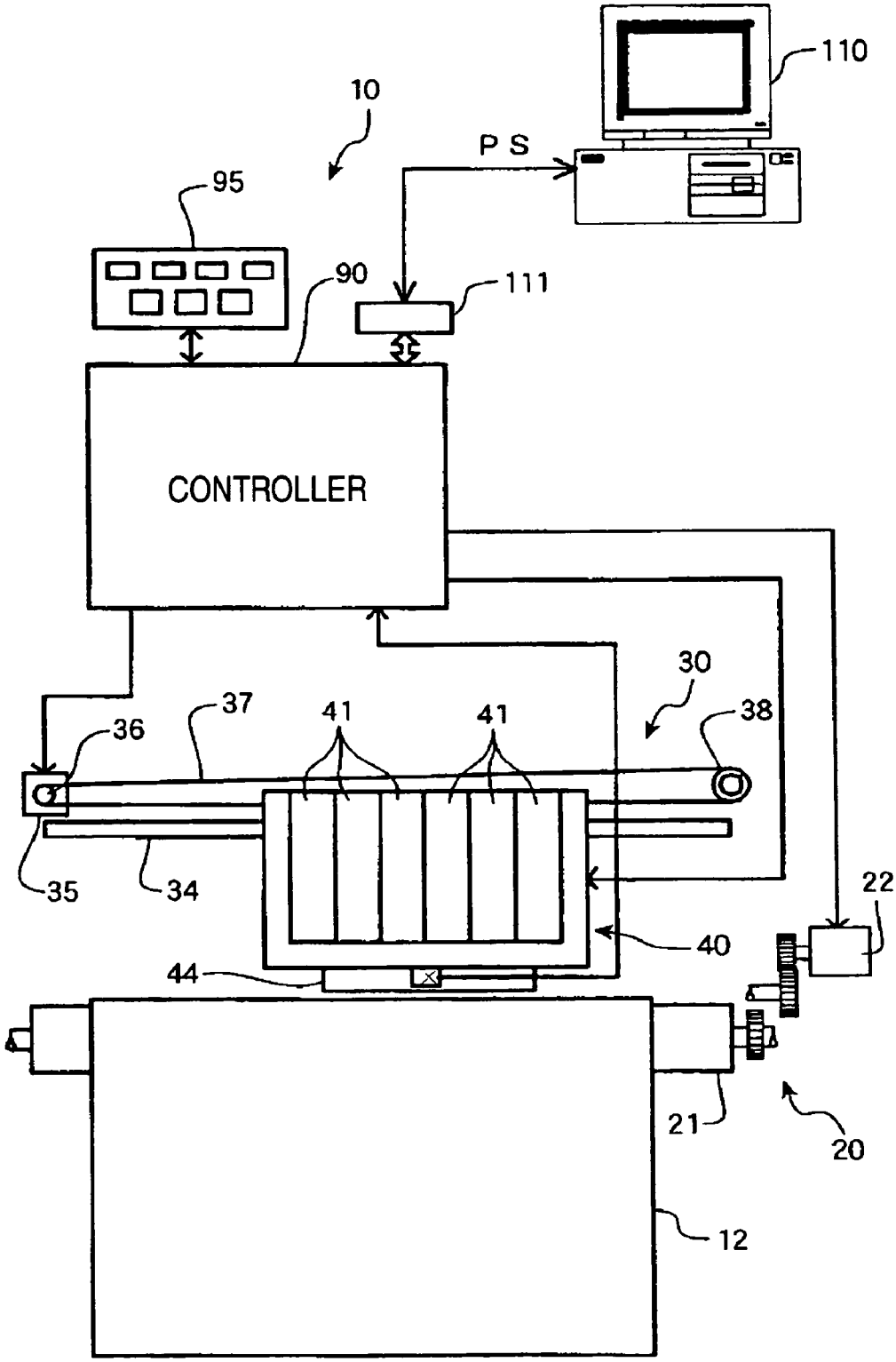
FIG. 2 is a schematic view showing a configuration of the printer.

As shown in FIG. 2, the medium conveyance mechanism 20 is provided with various rollers such as the medium feeding roller (not shown) and a medium transporting roller 21, and with a medium feeding motor 22 for driving these rollers. The driving force of the medium feeding motor 22 is transferred via a transmission mechanism 23 composed of a plurality of gears and the like.

Figure 1:
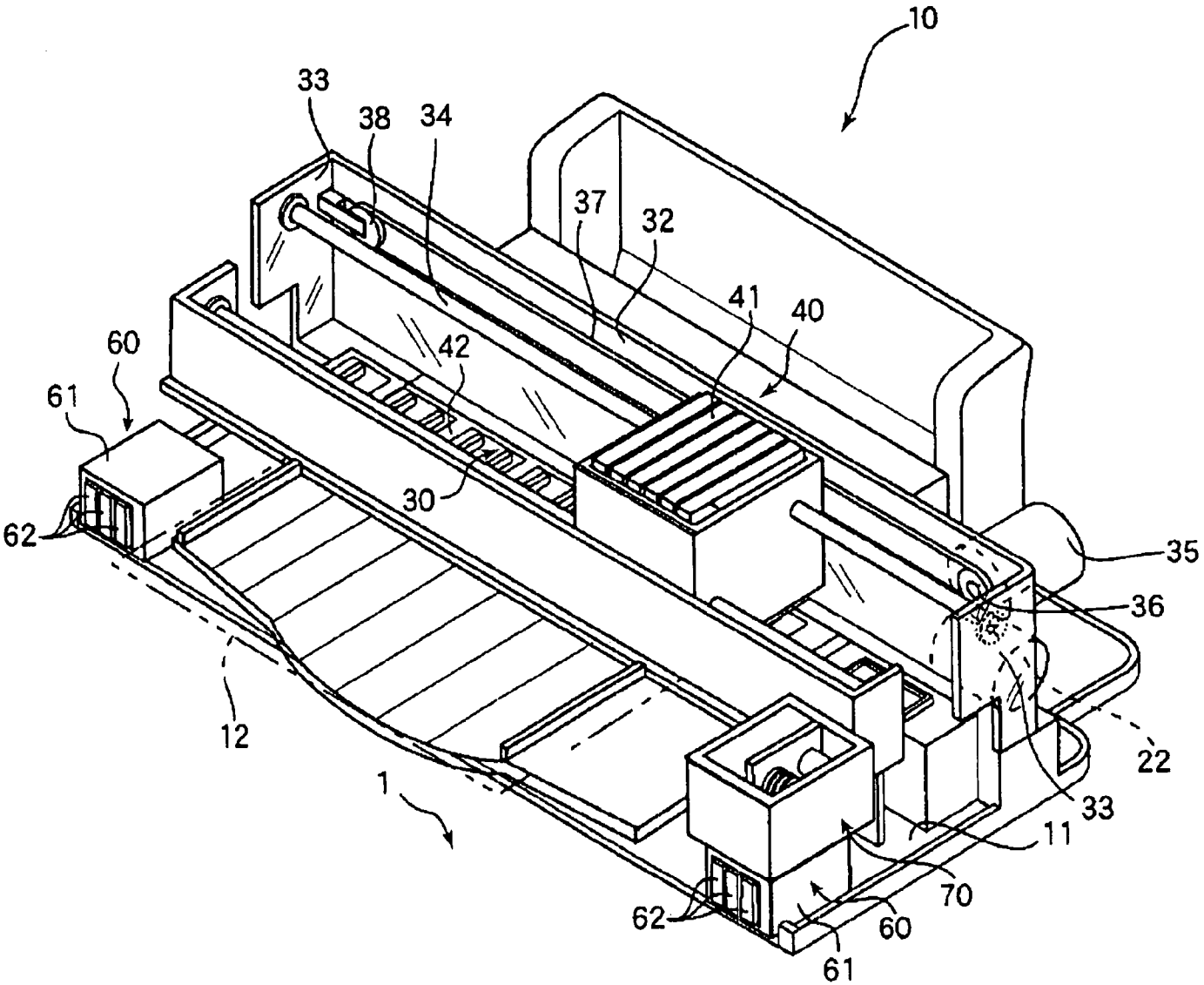
FIG. 1 is a perspective view of a printer according to a first embodiment of the invention.

As shown in FIG. 1 and FIG. 2, the carriage mechanism 30 comprises the carriage 40. The carriage mechanism 30 further comprises: a support frame 31; a carriage shaft 34 supported by the support frame 31 and retaining the carriage 40 in a slidable manner; the carriage motor 35; a gear pulley 36 attached to the carriage motor 35; an endless belt 37; and a follower pulley 38 for stretching the endless belt 37 from the gear pulley 36.

The follower pulley 38 is attached to one of side plates 33, while the gear pulley 36 is attached to a shielding plate 32 at a position closer to the other one of the side plates 33. The belt 37 a part of which is fixed to the carriage 40 is wound around the follower pulley 38 and the gear pulley 36.

As shown in FIG. 1, the support frame 31 comprises: the shielding plate 32; and the side plates 33 bent toward the front side at the both end portions of the shielding plate 32. A pair of side plates 33 support the carriage shaft 34 for guiding the sliding of the carriage 40 along the longitudinal direction of the chassis 11. Further, the carriage motor 35 for driving the gear pulley 36 is provided on the rear side of the shielding plate 32.

The gear pulley 36 is attached to a rotary shaft of the carriage motor 35 on the rear side of the shielding plate 32. Further, in the chassis 11, a platen 42 is provided in a part on the front side to the support frame 31 (shielding plate 32). The platen 42 is attached such that its longitudinal direction should align with the longitudinal direction of the chassis 11. The upper surface of the platen 42 serves as the medium feeding surface for feeding the printing medium 12'. Here, a material conveyed on the upper surface of the platen 42 is not limited to the printing medium 12, and may be a conveyance tray or the like for retaining the printing medium 12.

Further, the carriage 40 is provided in a manner opposing the platen 42. In the inside of the carriage 40, liquid containers 41 can be installed in the same number as the colors (six colors in FIG. 2) of the cartridges 62 described later. Each liquid container 41 is connected to one end of a liquid pipe 43 composed of a flexible tube or the like. Each color of the cartridges 62 is supplied to each liquid container 41 via the liquid pipe 43.

The configuration is not limited to that the liquid containers 41 are provided in the same number as the colors of the cartridges 62. For example, when the inside of the liquid container 41 is partitioned without leakage, the number of the liquid containers 41 may be fewer than the number of colors of the cartridges 62.

Figure 4:
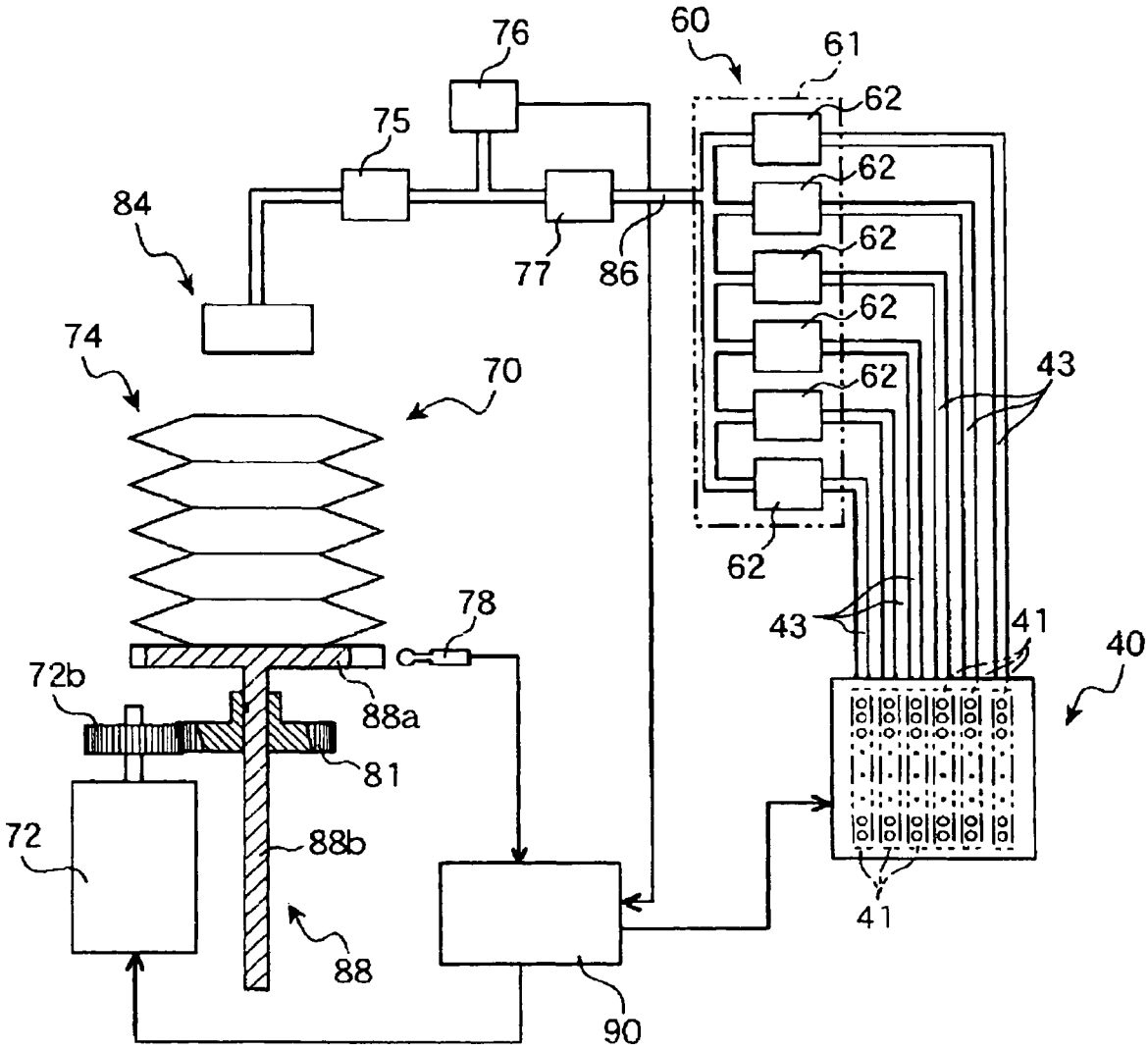
FIG. 4 is a schematic view of the pump unit, showing a state that a bellows pump is expanded.

As shown in FIG. 2, in the lower part of the carriage 40, a print head unit 44 provided with a print head 45 protrudes toward the platen 42 side. A large number of nozzles 45*a* shown in FIG. 4 are formed on the lower end side of the print head 45. Thus, the ink supplied from each liquid container 41 is ejected as an ink drop from each nozzle 45*a* toward the printing medium 12.

An unshown outer case is attached to the chassis 11. The outer case covers the mechanisms of the printer 10, and thereby protects these mechanisms from shock, dust, and the like. Further, as shown in FIG. 1, the chassis 11 is provided with the cartridge mounting sections 60. The cartridge mounting sections 60 are provided on both end portions of the primary scanning direction in the chassis 11, and arranged on the front side of the chassis 11. Each cartridge mounting section 60 is provided with a housing 61 in which the cartridges 62 are mounted. In the present embodiment, six colors, for example, of K (black), LM (light magenta), LC (light cyan), C (cyan), M (magenta), and Y (yellow) are present in the cartridges 62 serving as liquid supply sources.

Figure 5:
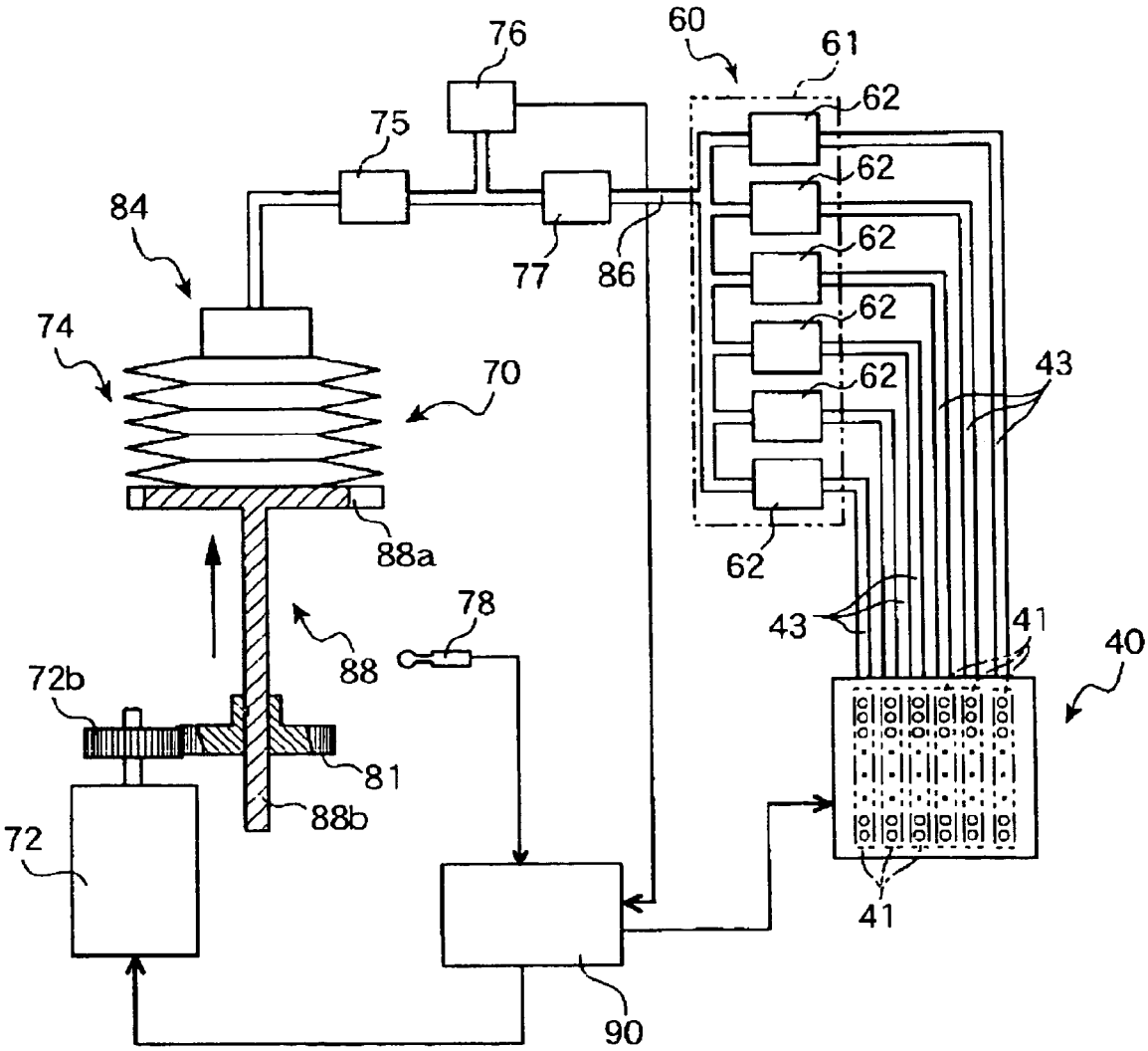
FIG. 5 is a schematic view of the pump unit, showing a state that the bellows pump is contracted.

As shown in FIG. 4 and FIG. 5, one end of the air pipe 86 is connected to the housing 61. The air supplied via the air pipe 86 is distributed to each cartridge 62. Accordingly, the ink present in each cartridge 62 is supplied into the liquid container 41 via a liquid pipe 43 by the pressure of this air. Here, the liquid pipes 43 of a number corresponding to the number of colors of the cartridges 62 are connected to the housing 61. By the pressure of the air described above, each liquid pipe 43 brings the ink present in the cartridge 62 into communication with the liquid container 41.

Figure 3:
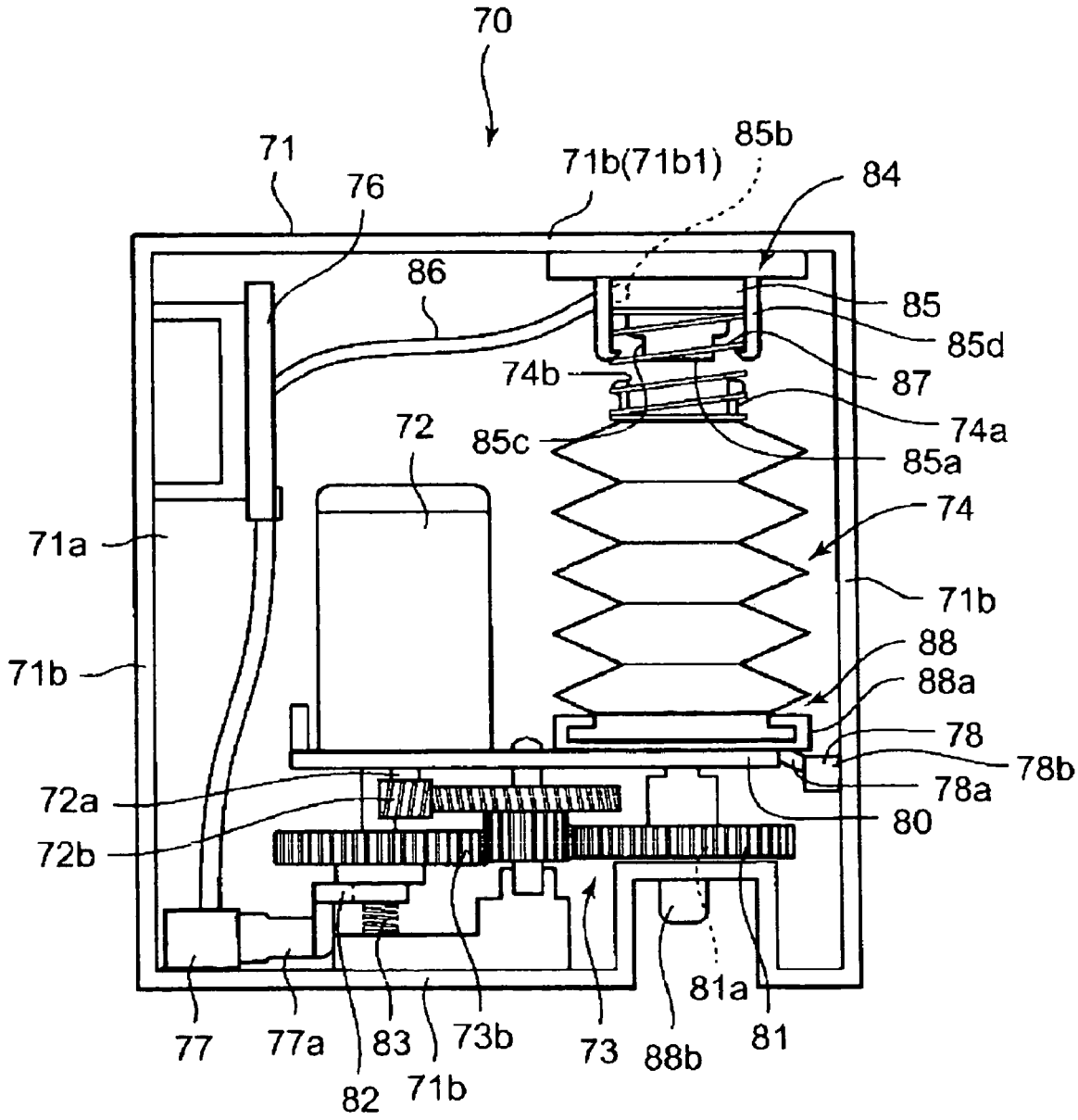
FIG. 3 is a section view of a pump unit in the printer.

As shown in FIG. 1, the pump unit 70 is provided in a part of the chassis 11 where interference does not occur with the carriage mechanism 30 (for example, on the front side end of the chassis 11). As shown in FIG. 3, the pump unit 70 comprises, as major components, a casing 71, a pump motor 72, a gear wheel train 73, a bellows pump 74, a check valve 75 (see FIG. 4), a pressure sensor 76, a regulator 77, and a position detector 78.

The casing 71 is provided in the form of a box in which a bottom wall 71*a* and four outer walls 71*b* cover the lower part and the side parts and in which the upper part is opened. The casing 71 is a member to which each member of the pump unit 70 is attached and which is installed on the chassis 11. In the inside of the casing 71, a support plate 80 is extended approximately in parallel to an outer wall 71*b*1.

Further, the support plate 80 is provided with the pump motor 72 which is provided with a rotary shaft 72*a* having a drive gear 72*b*. The pump motor 72 is a DC motor corresponding to PWM (Pulse Width Modulation) control, and revolves an output gear 81 by the electric power from a third motor driving circuit (described later). The gear wheel train 73 composed of a plurality of follower gears is installed in the casing 71. An output gear 81 engages with the gear wheel train 73. The gear wheel train 73 slows down the revolution of the driving force generated by the pump motor 72, and then transfers the force to the output gear 81. The output gear 81 is provided with a through hole 81*a* extending through the center in the radial direction. A guide shaft 88*b* described later is inserted into the through hole 81*a*.

A rotary lever 82 is coaxially provided in the second gear 73*b* of the gear wheel train 73. The rotary lever 82 is biased toward the second gear 73*b* by a spring 83. This biasing force causes the rotary lever 82 to revolve in synchronization with the second gear 73*b*. When revolving in the reverse rotation direction, the rotary lever 82 can engage with a protruding piece 77*a* of the regulator 77. Thus, when the second gear 73*b* revolves in the reverse rotation direction, the rotary lever 82 can collide with the protruding piece 77*a*, and thereby push down the protruding piece 77*a*.

The bellows pump 74 is attached between the support plate 80 and the outer wall 71*b* 1 described above. The bellows pump 74 is a bellows-shaped cylindrical member, and is made of flexible resin or the like. A reduced diameter part 74*a* having a smaller diameter than the other portion is provided on one end of the bellows pump 74. An end face on one end of the reduced diameter part 74*a* is opened to form an opening 74*b*, and thereby allows air to be taken into the inside of the bellows pump 74. In the present embodiment, the other end of the bellows pump 74 is not opened.

Further, the one end of the bellows pump 74 where the opening 74*b* is present is received by a retainer 84. The retainer 84 is attached to the outer wall 71*b*1. The retainer 84 is provided with an air deriving section 85 protruding toward the support plate 80 side of the bellows pump 74. The air deriving section 85 is a portion into which air is supplied by the expanding and contracting action of the bellows pump 74. Thus, the air deriving section 85 is provided with an air inlet 85*a* through which the air is supplied from the bellows pump 74.

Further, the air deriving section 85 is provided with an air outlet 85*b*, while one end of the air pipe 86 is attached to the air outlet 85*b*. The other end of the air pipe 86 is connected to the cartridge 62, so that the air can be supplied into the cartridge 62. Further, the air deriving section 85 is provided with an engaging section 85*c* for entering the inside of the bellows pump 74 through the opening 74*b*. When the engaging section 85*c* enters the inside of the bellows pump 74 and thereby engages therewith, the air inside the bellows pump 74 is prevented from leaking even when the bellows pump 74 contracts.

A spring 87 is provided between the air deriving section 85 and the one end of the bellows pump 74. The spring 87 is provided in such a manner that a spring locking claw 85*d* of the air deriving section 85 prevents the spring from separating. Further, the spring 87 is provided on the periphery side of the engaging section 85*c*, and thereby generating a biasing force in the direction from the opening side toward the support plate 80 side of the bellows pump 74. Thus, when the bellows pump 74 is in the expanded state, the one end of the bellows pump 74 receives a biasing force toward the other end by virtue of the biasing force of the spring 87, so that the opening 74*b* departs from the engaging section 85*c*. Accordingly, when the bellows pump 74 is in the expanded state, the air can enter the inside of the bellows pump 74.

In the course that the bellows pump 74 sifts to the contracted state, the opening 74*b* engages with the engaging section 85*c* again, so that the state is established that the air taken into the inside of the bellows pump 74 does not leak. After that, when the bellows pump 74 contracts further, the air inside the bellows pump 74 is extruded from the inside of the bellows pump 74 to the air pipe 86, so that the air pressure caused by the extrusion of the air acts on the inside of the cartridge 62 via the air pipe 86.

Further, in the middle part of the air pipe 86, a check valve 75 (see FIG. 4) is provided that prevents the reverse flow of the air from the bellows pump 74 toward the cartridge 62, and thereby achieves the retention of the pressure. The check valve 75 may be provided in the middle part of the air pipe 86, while another configuration may be employed that the check valve 75 is built in the retainer 84

Further, a retainer 88 is provided on the other end of the bellows pump 74. The retainer 88 comprises a receptacle section 88*a* and a guide shaft 88*b*. These two sections are provided integrally. Among these, the receptacle section 88*a* receives the other end of the bellows pump 74. The guide shaft 88*b* is inserted into the through hole 81*a* of the output gear 81 described above, and provided in such a manner that free insertion is permitted through the through hole 81*a*.

Figure 7:
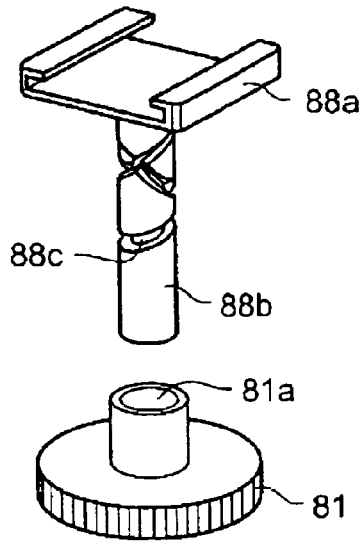
FIG. 7 is a perspective view of a pump retainer in the pump unit.

Further, as shown in FIG. 7, a spiral groove 88*c* is formed in the guide shaft 88*b*. An engaging protrusion 81*b* protruding from the inner wall face of the through hole 81*a* enters into the spiral groove 88*c*. Thus, when the engaging protrusion 81*b* revolves in association with the revolution of the output gear 81, the guide shaft 88*b* is pushed by the engaging protrusion 81*b*, and thereby performs reciprocating motion along the direction of the axis of the bellows pump 74. As such, expanding and contracting action is achieved in the bellows pump 74. Here, the spiral groove 88*c* forms a closed loop for causing the retainer 88 to perform reciprocating motion when the output gear 81 revolves in one direction.

Further, a pressure sensor 76 is attached to the casing 71. The pressure sensor 76 is a reflection type sensor provided with a light emitting element and a light receiving element, and comprises a cover member (not shown) and a thin film member (also not shown) composed of cellophane or the like. When a load of the air pressure is applied to the thin film member, the thin film member bulges. This bulge causes the thin film member to approach the cover member. When they approach each other within a certain distance, light emitted from the light emitting element can be detected in the light receiving element, so that the pressure is detected.

Further, the air having passed through the pressure sensor 76 is supplied into the regulator 77. The regulator 77 is provided with the protruding piece 77*a*. The regulator 77 is arranged so as to release the pressure when the protruding piece 77*a* is pushed in downward by the rotary lever 82. Further, the regulator 77 automatically releases the pressure when receiving a pressure load of a predetermined pressure or higher.

Here, when the second gear 73*b* revolves in the normal rotation direction, the rotary lever 82 moves upward, so that the rotary lever 82 does not engage with the protruding piece 77*a*. However, when the gear wheel train 73 revolves in the reverse rotation direction, the rotary lever 82 moves downward, and thereby collides with and pushes down the protruding piece 77*a*. As such, the protruding piece 77*a* can be switched.

Further, a position detector 78 is attached to the casing 71. The position detector 78 is provided with a detection lever 78*a* capable of rotating. The detection lever 78*a* can abut against the receptacle section 88*a*. Further, the detection lever 78*a* protrudes from a main body 78*b* incorporating a switch for transmitting a signal of High (H)/Low (L). When this switch of H/L is changed, the expanded state of the bellows pump 74 can be detected. Here, when the bellows pump 74 is in the contracted state, the detection lever 78*a* is not pushed in by the receptacle section 88*a*, and is located on the one end close to the bellows pump 74. In contrast, when the bellows pump 74 is in the expanded state, the detection lever 78*a* is pressed into the other end by the motion of the receptacle section. 88*a*, so that the signal is switched. Accordingly, the expanded state of the bellows pump 74 can be detected.

In the present embodiment, the position detector 78 is arranged such that the H/L is switched at the position where the bellows pump 74 is fully expanded. Further, in the configuration of the present embodiment, when the bellows pump 74 is fully expanded and hence the detection lever 78*a* is pushed, an H signal is transmitted.

Next, the configuration of the controller 90 is described below with reference to FIG. 6. The controller 90 comprises a bus 90*a*, a CPU 91, a ROM 92, a RAM 93, a character generator 94, an interface circuit 95, a direct current circuit 96, a first motor driving circuit 97, a second motor driving circuit 98, a head driving circuit 99, a third motor driving circuit 100, a non-volatile memory 101, and the like. The controller 90 cooperates with these components.

The CPU 91 and the DC circuit 96 receive output signals from various kinds of unshown sensors such as: a rotary encoder for detecting the rotation of the conveyance roller 21; a linear encoder for detecting the amount of traveling of the carriage 40; a medium detector for detecting the leading edge and the trailing edge of the printing medium 12; a medium width detector for detecting the width (dimension in the secondary scanning direction) of the printing medium 12; and a power switch for turning on/off the power of the printer 10.

The CPU 91 performs arithmetic operation for executing the control program for the printer 10 stored in the ROM 92, the non-volatile memory 101, or the like, as well as performs other necessary arithmetic operations.

Further, the ROM 92 stores the control program for controlling the ink jet printer 10 and data or the like necessary for processing. In the present embodiment, the ROM 92 also stores: an initial value of target information corresponding to the target revolution rate of the pump motor 72. The target information corresponds to such a revolution rate of the pump motor 72 that the noise generated from the pump unit 70 does not fall within the audible range. The ROM 92 also stores an initial value of the control table of the duty ratio of the voltage applied to the pump motor 72. However, the target information and the control table may be stored in the non-volatile memory 101 in advance.

Figure 8:
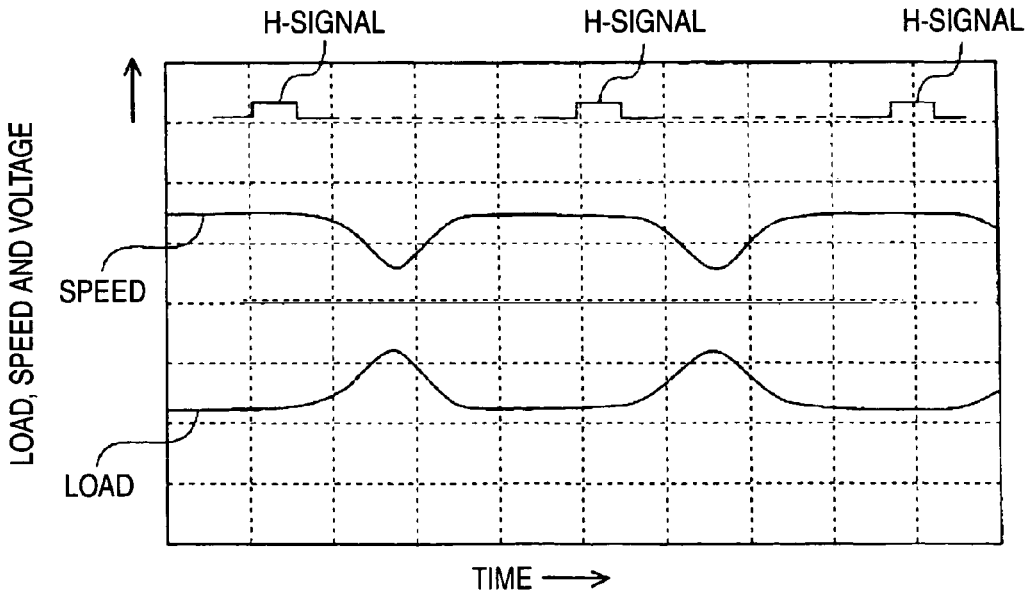
FIG. 8 is a graph showing a relationship between a driving speed and a driving load of a pump motor in the pump unit, under a condition that a duty ratio of a driving voltage signal is made constant.

Here, the control table is described below on the basis of FIG. 8 and FIG. 9. In a case where the duty ratio of the voltage is set to be constant within one cycle after the position detector 78 has detected an H signal and until the sensor detects the next H signal, the relationship between the load and the speed of the pump motor 72 is as shown in FIG. 8. This figure merely shows the waveforms of the load curve, the speed curve, and the H signal detection and the specification of the units thereof are omitted.

In FIG. 8, the load of the bellows pump 74 is the highest after an H signal is detected first and slightly before the bellows pump 74 is fully contracted. Thus, in this portion, the speed of the pump motor 72 is the slowest. However, in the portion where the line indicating the load becomes almost flat in the lower part, the load is light so that the speed of the pump motor 72 becomes fast. Thus, the relationship between the load acting on the pump motor 72 and the driving speed of the pump motor 72 is almost symmetric with respect to a line parallel to the time axis.

Meanwhile, when a speed fluctuation as shown in FIG. 8 occurs in the pump motor 72 (the bellows pump 74) within the above-mentioned one cycle, this speed fluctuation generates a fluctuation (a beat) in the noise. Thus, in order that the generation of the beat should be prevented, the duty ratio of the voltage is changed within one cycle such that the range of the fluctuation should be reduced in the speed of the pump motor 72.

Figure 9:
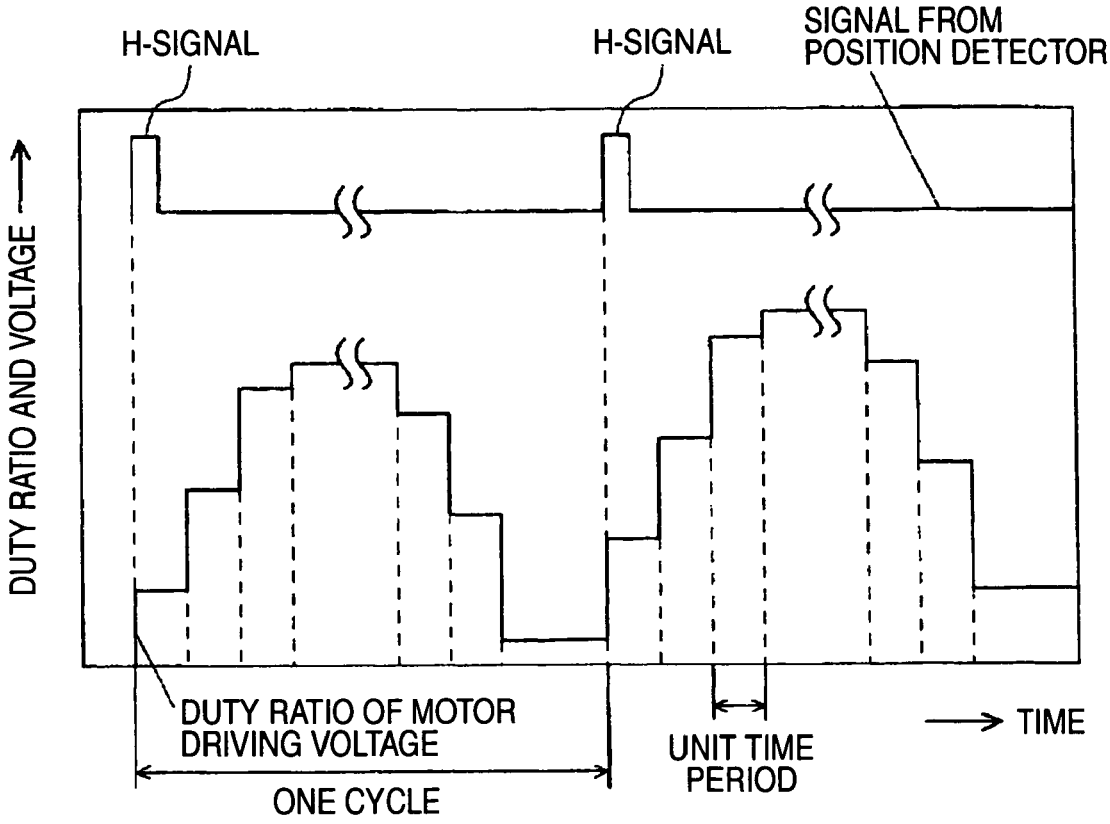
FIG. 9 is a graph showing how to vary the duty ratio within one cycle of the pumping action of the bellows pump.

FIG. 9 shows a graph of such a duty ratio of the voltage. This figure merely shows the waveforms of the duty ratio and the H signal detection, and the specification of the units thereof are omitted. As shown, one cycle is divided into N parts, for example, into 20 parts. Then, in each divided unit time period, with using as the reference the speed of the pump motor 72 where the load shown in FIG. 8 reaches a peak (referred to as a reference speed, hereinafter), the duty ratio is adjusted in each unit time period such that the speed should approach the reference speed. Then, in the driving speed of the pump motor 72 within one cycle, the fluctuation is suppressed, or alternatively, the driving speed becomes almost constant, the state is achieved that no beat is generated.

The ROM 92 stores in advance the control table (see FIG. 9) of the duty ratio of the voltage that reduces the fluctuation of the driving speed of the pump motor 72 within one cycle or alternatively realizing an almost constant driving speed. Such a control table of the duty ratio can be determined by an experiment or the like in advance. That is, a change in the load as shown in FIG. 8 is acquired at a specific initial revolution rate. Then, on the basis of the change in the load, a fluctuation curve of the duty ratio for realizing a constant speed is acquired. After that, the fluctuation curve is divided into N parts within one cycle, so that a duty ratio is determined for each divided unit time period. After that, the pump motor 72 is driven at the duty ratio. Then, when the speed change is confirmed as falling within a certain range, the control table of the duty ratio of the voltage is eventually defined.

Here, the control table may be prepared according to a method that the waveform is defined in advance as shown in FIG. 9 and that a correction amount $\alpha 1$ described later is added or subtracted uniformly to or from the duty ratios of all unit time periods. Alternatively, a method may be adopted in which the correction amount is increased or decreased proportionally to the reference: speed or another target speed.

Further, a method may be adopted in which the correction amount $\alpha 1$ is calculated individually for the duty ratio of each unit time period on the basis of the reference speed or another target speed, and then added, subtracted, or the like to or from each duty ratio.

Here, when the peak of the load shown in FIG. 8 overlaps with the peak of the duty ratio shown in FIG. 9, the pressurization can be performed satisfactorily by the bellows pump 74. Nevertheless, in some cases in actual driving of the actual pump motor 72, the peak of the load shown in FIG. 8 does not overlap with the peak of the duty ratio shown in FIG. 9, and deviates with respect to time. In the case of occurrence of such deviation, the situation can arise that a low duty ratio is applied at the peak of the load. This causes a possibility that the bellows pump 74 does not achieve appropriate pressurization. In particular, in a case where the peak of the duty ratio arrives first with respect to time and that the peak of the load arrives after the peak of the duty ratio has passed, the peak of the load needs to be overcome in a state that a low duty ratio is applied. Thus, in a case where the peak of the duty ratio arrives first with respect to time, the possibility that the pressurization is not appropriately performed increases more in comparison with the case that the peak of the load arrives first with respect to time.

Thus, when this probability is present, in the duty ratio of the voltage, it is preferable that the time of the peak of the duty ratio of the voltage is set longer than the time of the peak of the load so that the width of the unit time period where the duty ratio of the voltage is at peak is set slightly wider. In a case where the width of the unit time period is set slightly wider, this widening is performed within a range where the problem of noise does not arise. Then, the unit time period of the duty ratio of the voltage becomes long, so that the peak of the load can be covered appropriately.

The pump motor 72 is initially driven on the basis of this control table of the duty ratio. Further, after the pump motor 72 is initially driven with this set up, in a case where the speed of one cycle in the driving of the pump motor 72 agrees approximately with the target speed, the unit time period of the peak of the duty ratio having been set long may be shortened.

Figure 12:
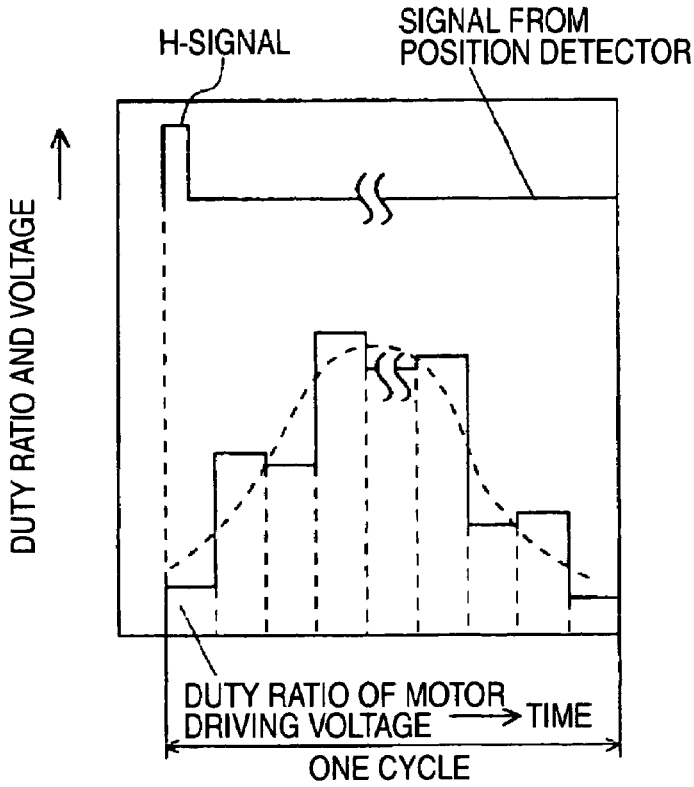
FIG. 12 is a graph showing a first modified example of the way to vary the duty ratio.

Further, as shown in FIG. 12, when the estimated (prescribed) profile is shown as dashed lines, the duty ratio of each unit time period may be set up such that a speed-up and a speed-down are alternately repeated with respect to the this profile. This method suppresses that the duty ratio deviates from the estimated profile for two or three unit time periods, and suppress that the speed increases or decreases greatly.

Figure 13:
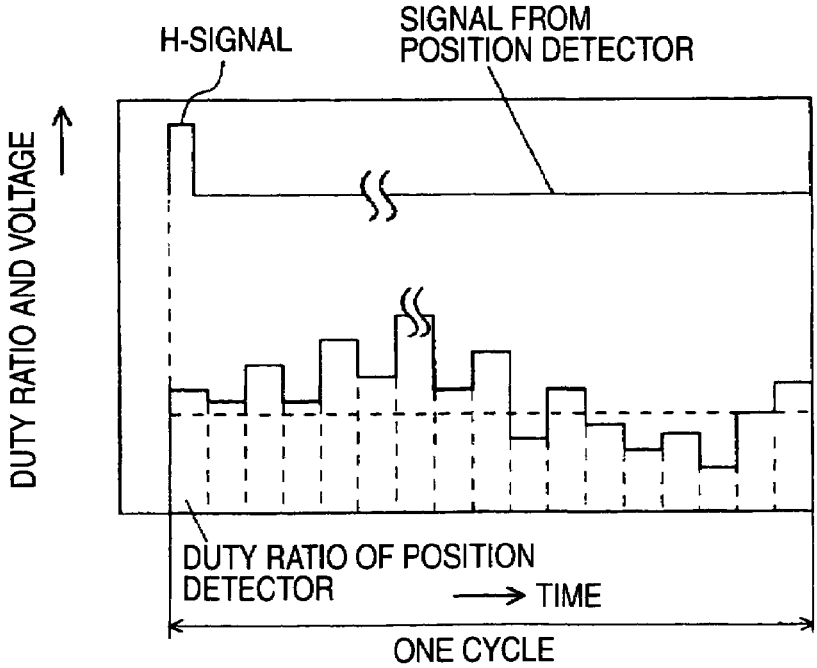
FIG. 13 is a graph showing a second modified example of the way to vary the duty ratio.

Furthermore, as shown in FIG. 13, when the estimated (prescribed) profile is shown as dashed lines (approximated by a straight line in this case), a portion may be provided that reduces the speed when the speed is fast (the unit time periods of the duty ratio: below the right-hand side profile in FIG. 13), while a profile may be provided in which the mean duty ratio in the entirety is set slightly high. In this case, for example, when the control is terminated (the duty ratio is fixed at this time) in the right-hand side portion of FIG. 13 where the duty ratio is low, the speed can be reduced in a case where the speed is slightly fast. On the contrary, when the speed is slightly slow, the entire profile is performed. This method permits finer speed adjustment.

Further, in the present embodiment, three modes of driving the pump motor 72 are present as described later. Thus, the control programs of the printer 10 are present in a number corresponding to the number of these modes. Further, the interface circuit 95 incorporates a parallel interface circuit, and hence can receive a printing signal PS provided from the computer 110 via the connector 111.

The RAM 93 is a memory for temporarily storing a program presently executed by the CPU 91 or data and the like in the course of operation. Further, the non-volatile memory 101 is a memory for storing various data that need to be retained even after the ink jet printer 10 is deactivated. As described later, the non-volatile memory 101 also stores the duty ratio of the voltage in the case of stopping the driving of the pump motor 72. However, these control data, target information, and the like may be stored into another storage region.

Further, the DC circuit 96 is a control circuit for performing the speed control of the medium feeding motor 22 and the carriage motor-35 which are DC motors. On the basis of a control instruction transmitted from the CPU 91, an output signal of the rotary encoder, an output signal of the linear encoder, and an output signal of the medium detector, the DC circuit 96 performs various operations for performing the speed control of the medium feeding motor 22 and the carriage motor 35, and then, on the basis of the operation result, transmits motor control signals to the first motor driving circuit 97 and the second motor driving circuit 98.

Further, on the basis of the motor control signal from the DC circuit 96, the first motor driving circuit 97 drives and controls the medium feeding motor 22. Further, on the basis of the motor control signal from the DC circuit 96, the second motor driving circuit 98 drives and controls the carriage motor 35. Here, each of the medium feeding motor 22 and the carriage motor 35 can hold its position in the stopped state.

Further, on the basis of a signal for drive controlling transmitted from the CPU 91, the head driving circuit 99 controls and drives a piezoelectric element provided in the print head 45. The third motor driving circuit 100 controls and drives the pump motor 72. The pump motor 72 is also a DC motor, and can easily be driven and controlled by PWM control when a pulse voltage of an optimal frequency for driving is applied.

Here, the PWM control indicates a method that a PWM signal for rapidly switching between the H and L states of the voltage adjusts the duration of the H state of the pulse voltage applied to a DC motor (the duration of the H state within one cycle of the pulse voltage is referred to as the duty ratio, hereinafter), and thereby adjusts the mean voltage of the pulse voltage, so that the DC motor is driven and controlled.

In such a PWM control, equal-width pulses where every pulse has a uniform pulse width are used in a certain method, while unequal-width pulses where the pulse width varies are used in another method. However, either kind of pulse signal may be used. Further, any kind of pulse signal may be used where the duty ratio of the voltage pulse and the period of the voltage pulse are adjusted in various manners in combination.

Each component in the above-mentioned controller 90 is connected through the bus 90*a* composed of signal lines. The bus 90*a* connects the CPU 91, the ROM 92, the RAM 93, the character generator 94, the interface circuit 95, the non-volatile memory 101, and the like to each other, and thereby permits data transfer between these components.

Details of the control are described below for the case that the printer 10 is driven according to the above-mentioned configuration. Here, in the present embodiment, the controller 90 can drive the pump motor 72 in three modes. These three modes consist of: a "quiet mode" which is quietest; a "medium mode" which is moderately quiet but in which the printing speed is also prioritized; a "speed mode" in which the speed is prioritized without attention to the noise. The following description is given, among the three modes, for the case of the quiet mode in which the noise generated from the pump unit 70 is suppressed and which is quietest.

Figure 10:
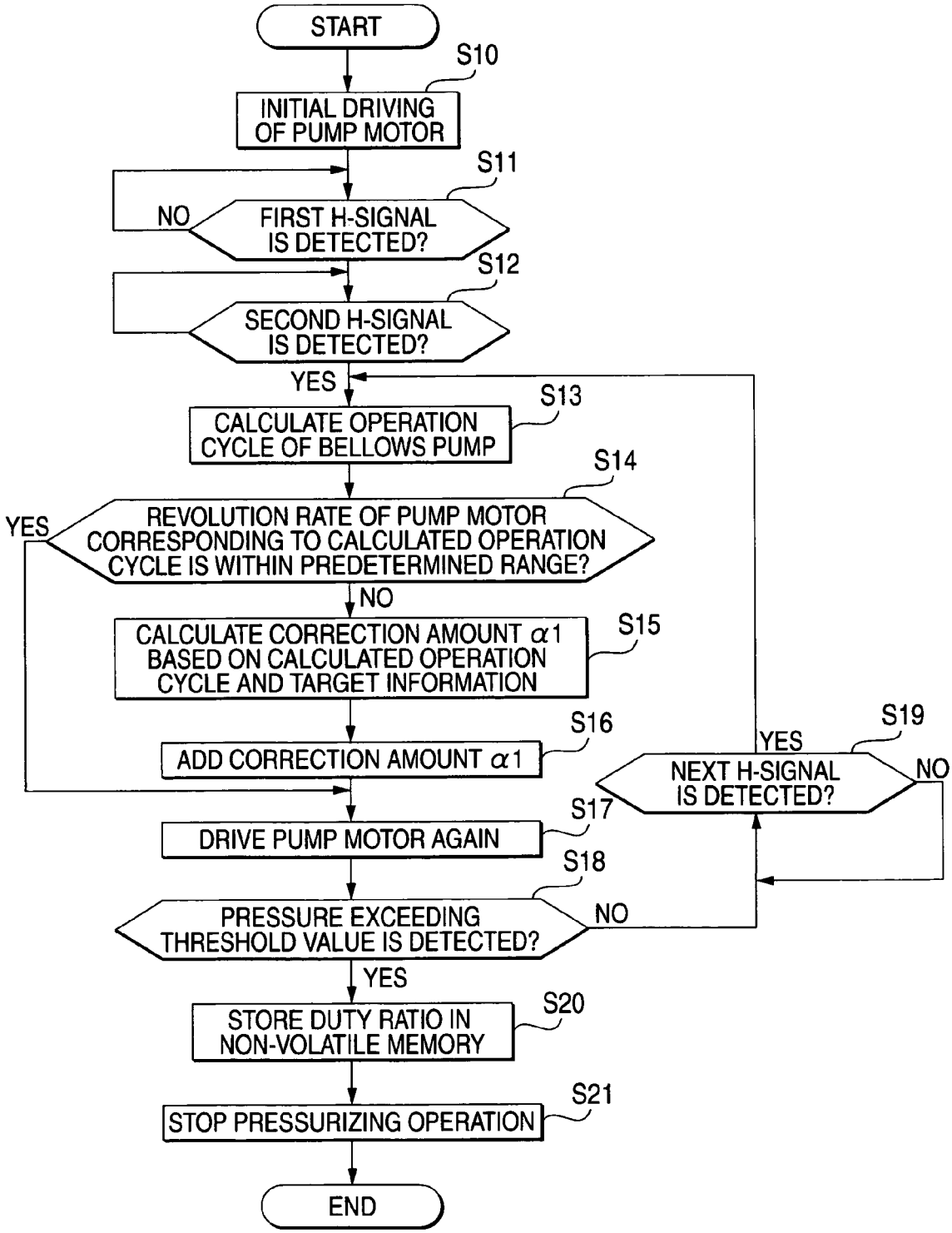
FIG. 10 is a flow chart showing how to control the pump unit when the pump motor is initially driven.

An initial driving of the pump motor 72 will be described below on the basis of FIG. 10. The initial driving of the pump motor 72 is performed when the power switch of the printer 10 is turned ON so that the printer 10 is activated. In addition, the initial driving may be performed when: the cartridge 62 is changed so that the pressure becomes equal to the atmospheric pressure; and when the printer 10 is used after a long-term unused state.

Step S10: the power switch of the printer 10 is turned ON so that the operation of the printer 10 is activated. Then, the pump motor 72 operates, so that the pumping action of the bellows pump 74 starts. Here, in the initial driving, the pump motor 72 is driven on the basis of the control table (for initial driving) of the duty ratio stored in the ROM 92 as shown in FIG. 9.

Meanwhile, when the pump motor 72 is initially driven, the time until the first H-signal is transmitted does not correspond to one cycle in many cases. That is, in a case where the retainer 88 has pushed in the detection lever 78*a* of the position detector 78 before the printer 10 starts, one cycle can accurately be measured from the beginning. Nevertheless, in a case where the retainer 88 has not pushed in the detection lever 78*a*, the time of one cycle cannot accurately be measured at the first cycle.

Thus, in the present embodiment, during the two cycles consisting of a cycle until the first H-signal is transmitted (corresponding to the first cycle) and a cycle between the first transmitted H-signal and the second transmitted H-signal (corresponding to the second cycle), the pump motor 72 is driven according to a duty ratio of the voltage determined by using the above-mentioned control table of the duty ratio for initial driving. Thus, voltage having the duty ratio of the pump motor 72 is changed at and after the third cycle (the time after the transmission of the second H-signal and until the transmission of the third H-signal). That is, the time from an H-signal to the next H-signal can accurately be measured only at and after the second cycle, while this accurate time of the second cycle can be reflected only at and after the third cycle.

Here, in a case where the time of the first cycle can accurately be measured, the measured time may be reflected at the second cycle.

Then, on the basis of the duty ratio of the control table for initial driving, the pump motor 72 is driven for two cycles (the time until the position detector 78 transmits the second H-signal). Here, at the time of startup, the initial load acts on the pump motor 72 as an additional load in comparison with the time that the operations of a several cycles has been performed. Thus, usually, the duty ratio of the control table for initial driving is set higher.

Step S11: the CPU 91 determines whether an H-signal has been received or not from the position detector 78. That is, when the detection lever 78*a* is pushed in by the receptacle section 88*a*, the position detector 78 transmits the first H-signal to the controller 90. In this determination, when it is determined that an H-signal has been received (in the case of Yes), the procedure moves to Step S12 described later. Further, when it is determined that no H-signal has been received (in the case of No), the procedure returns to a point before this Step S11.

Step S12: when the CPU 91 determines that the first H-signal has been received, the CPU 91 then determines whether the second H-signal has been received or not. In this determination, when it is determined that an H-signal has been received (in the case of Yes), the procedure moves to the next Step S13. Further, when it is determined that no H-signal has been received (in the case of No), the procedure returns to a point before this Step S12.

Step S13: the CPU 91 calculates the operation cycle of the bellows pump 74 measured using the position detector 78 (corresponding to the drive information calculating step). The operation cycle mentioned here is the time period after the position detector 78 transmits a first H-signal and until the sensor transmits a second H-signal. Here, in a case where Step, S14 described later has been performed, the period to be calculated is the time between, a new. H-signal transmitted by the position detector 78 after the adding of the correction amount $\alpha$1 and an H-signal immediately before the new H-signal.

Step S14: on the basis of the calculation of the operation cycle obtained at the above-mentioned Step S13, the CPU 91 determines whether the revolution rate of the pump motor 72 corresponding to the operation cycle falls within predetermined range or not. That is, on the basis of the calculated period, the CPU 91 calculates the revolution rate of the pump motor 72 that corresponds directly to the operation cycle, and then determines whether the calculated revolution rate of the pump motor 72 falls within an appropriate target range or not. In this determination, when it is determined as within the appropriate range (in the case of Yes), the procedure moves on to Step S17 described later. When it is determined as outside the appropriate range (in the case of No), the procedure moves to the next Step S15. Here, the appropriate range of the revolution rate indicates a range between the maximum revolution rate where the generated noise is not very noisy and the minimum revolution rate calculated from the allowable time period until the pressure reaches the threshold value.

Step S15: the CPU 91 calculates a correction amount $\alpha$1 from the calculated revolution rate and the target information stored in the non-volatile memory 101. That is, the correction amount $\alpha$1 is calculated such that the pump motor 72 should operate at a revolution rate within the appropriate range. That is, when the revolution rate of the pump motor 72 is controlled so as to approach a desired value within the appropriate range, the noise generated from the mechanical parts can be reduced to a target noise level or lower. Thus, at Step S15, the correction amount $\alpha$1 added to the duty ratio is determined from the relation of the duty ratio of the present voltage and revolution rate relative to the target revolution rate.

Here, the ROM 92 may store in advance a table of the correction amount $\alpha$1 corresponding to the revolution rate of the pump motor 72. In this case, the table of the correction amount $\alpha$1 can be determined by an experiment or the like, so that the table is stored into a storage section of the ROM 92 or the like. In this case, a correction amount $\alpha$1 is called out such that the calculated revolution rate of the pump motor 72 should become nearest to the revolution rate in the table. As such, the calculation of the correction amount $\alpha$1 is achieved.

Further, in place of the use of such a table of the correction amount $\alpha$1 stored in advance, the correction amount $\alpha$1 may be calculated successively. In this case, the correction amount $\alpha$1 is calculated on the basis of a prediction that when the mechanical load fluctuates, the initial revolution rate of the pump motor 72 varies proportionally to the fluctuation of the load. That is, since the characteristics of the pump motor 72 are known in advance, the mechanical load can be calculated from the initial revolution rate of the pump motor 72. Thus, the correction amount $\alpha$1 for bringing the revolution rate of the pump motor 72 into the target revolution rate can be calculated.

When the correction amount $\alpha$1 is added as described above, in a case where the difference is large between the calculated revolution rate of the pump motor 72 and the target information (target revolution rate), the correction amount $\alpha$1 has a large value. As the difference becomes smaller, the correction amount α1 also becomes smaller.

Step S16: the CPU 91 adds the above-mentioned correction amount α1 to voltage having the duty ratio. That is, at the next cycle (the third cycle; a cycle after the last H-signal is received and until a new H-signal is received, in a case where Step S19 has been performed once), the voltage having a duty ratio to which the correction amount α1 has been added is applied to the pump motor 72. In this case, the duration of one pulse signal varies owing to the added correction amount α1.

Step S17: the third motor driving circuit 100 applies voltage having the duty ratio to which the above-mentioned correction amount α1 has been added, to the pump motor 72 at the next and the subsequent cycles, so that the pump motor 72 is driven.

Step S18: the CPU 91 determines whether an H-signal notifying that the pressure value exceeds the threshold value has been received from the pressure sensor 76 or not. Here, this determination is achieved by receiving an H-signal or receiving an L-signal when the threshold value is exceeded similarly to the case of the position detector 78 described above. Then, when it is determined that the pressure value exceeds the threshold value (in the case of Yes), the procedure moves to Step S20 described later. Further, when it is determined that the pressure value does not exceed the threshold value (in the case of No), the procedure moves to Step S19.

Step S19: the CPU 91 determines whether after the correction amount α1 has been added, a new (next) H-signal has been received or not from the position detector 78. In this determination, when it is determined that an H-signal has been received (in the case of Yes), the procedure returns to Step S13 described above. Further, when it is determined that no H-signal has been received (in the case of No), the procedure returns to a point before this Step S19.

Step S20 the CPU 91 stores into the non-volatile memory 101 voltage having the duty ratio to which the newest correction amount α1 has been added: In the next startup, preferably, this duty ratio is called out so that the pump motor 72 is driven on the basis of this duty ratio.

Step S21: the CPU 91 stops the operation of the pump motor 72. In this case, the pump motor 72 is stopped at the edge where the retainer 88 pushes in the detection lever 78*a*. When this condition is satisfied, in a case where the driving of the pump motor 72 is started at the next time; the accurate period can be measured starting from the stage that the CPU 91 receives the first H-signal.

Nevertheless, in the case of a certain trouble, the apparatus can stop in a halfway position where the bellows pump 74 does not push in the position detector 78. In order that such a case should be treated, preferably, the time of the second cycle measured accurately is also reflected at the third cycle in the subsequent operation of the pump motor 72.

In some cases such as that a child performs certain mischief, voltage having the duty ratio applied to the pump motor 72 can exceed the certain threshold value and move much higher. In this case, if the driving of the pump motor 72 were continued at the high duty ratio, the amount of heat generation from the pump motor 72 could become large so that the pump motor 72 could be heated abnormally. This could cause a fault such as wire breaking. In this case, after the stopping of the driving at Step S21, the operation of the pump motor 72 may be stopped for a prescribed time.

When the above-mentioned steps have been performed, in a case where the pump motor 72 is initially driven, even in a case where the revolution rate of the pump motor 72 deviates from the target revolution rate, the pump motor 72 eventually converges into the target revolution rate after the driving of the pump motor 72 has been continued for a predetermined time period.

Next, a case that the pump motor 72 is driven after a predetermined interval has been elapsed is described below on the basis of FIG. 11. Here, as described later, the phrase "after an interval has been elapsed" corresponds to: a case that the pressure is slightly below the threshold value of the pressure sensor 76 in a state that the printer 10 is in operation; and a case that the pressure is far below the threshold value of the pressure sensor 76 owing to a long-term no operation of the printer 10 regardless of the power ON/OFF.

Step S30: the CPU 91 reads out voltage having the duty ratio to which the correction amount α1 has been added and which is stored in the non-volatile memory 101.

Step S31: a correction amount α3 is added to the read-out duty ratio. The correction amount α3 may be determined in advance by an experiment or the like as described above, or alternatively may be calculated by a calculation. Here, since the purpose is to resolve the noise of the pump unit 70, the correction amount α3 to be added is preferably a negative value. However, the value of the correction amount α3 may be zero when the problem of noise is not caused.

Step S32: the third motor driving circuit 100 applies to the pump motor 72 voltage having a duty ratio to which the above-mentioned correction amount α3 has been added, so that the pump motor 72 is driven.

Here, steps after the Step S32 are similar to the Steps S11-S21 described above. In FIG. 11, Steps S11-S21 correspond to Steps S33-S43, respectively. Thus, detailed description thereof is omitted.

The case that the pump motor 72 is driven at or after the second time includes two situations: a situation that the interval is short so that the pressure measured in the pressure sensor 76 is slightly below the threshold value; and a situation that the operation of the printer 10 has been stopped for a long time so that the pressure is far below the threshold value in the pressure sensor 76. Thus, a plurality of correction amounts α3 are preferably provided depending on the non-operation time of the pump motor 72. For example, when printing is under execution in the printer 10, a correction amount α3*a* is used that reduces the correction amount α1 by a few %. In contrast, when the non-operation time period of the printer 10 is long so that the pressure is considerably low, a correction amount α3*b* is used that reduces by made them the correction amount α1.

That is, when the value of the correction amount α3*b* is reduced, a voltage having a large duty ratio is applied to the pump motor 72 in a state that the load by the pressure is small. When such a voltage is applied, a voltage almost the same as the voltage of the state that an appropriate revolution rate has been achieved in the pump motor 72 in a high pressure state before the interval is applied in a low pressure state. This increases the revolution rate of the pump motor 72 into a value far exceeding the appropriate revolution rate, so that noise is generated. Thus, the correction amount α3*b* needs to be larger than the correction amount α3*a*.

The situation that the pump motor 72 is operated from a state that the printer 10 has once been deactivated and that the pressure becomes almost equal to the atmospheric pressure may be included in a case where the above-mentioned correction amount α3*b* is applied.

According to the printer 10 having this configuration, the control table is divided into a large number of unit time periods, while the driving force of the pump motor 72 is increased or decreased depending on the value of the load of the pump motor 72 in each unit time period. Thus, when the control table is applied to the pump motor 72, the fluctuation (beat) of the driving speed of the pump motor 72 can be suppressed. Accordingly, in the noise generated from the load parts such as the bellows pump 74 and the other frictional parts, a fluctuation of the noise is suppressed so that the noisiness is reduced by an amount corresponding to the suppression of the fluctuation.

Further, the speed of the pump motor 72 in a portion where the load is at peak is used as the reference speed, while the duty ratio is adjusted in each unit time period so that the speed should approach the reference speed. Thus, in the pump motor 72, the driving speed of the pump motor 72 is adjusted so as to approach a portion where the load is large and the speed is slowest. Accordingly, the noise generated from the load parts such as the bellows pump 74 and the other frictional parts can be suppressed reliably. That is, when the target information is set up such that the noise generated from the load parts should move outside the audible range, as the pump motor 72 operates, on the basis of the detection in the position detector 78, noise generation can be reduced reliably. Further, a state is achieved that the fluctuation of the noise is suppressed satisfactory.

Further, noise generation can be suppressed merely by the detection in the position detector 78. This avoids the necessity of an encoder or the like for detecting the driving speed of the pump motor 72, and hence suppresses a cost increase.

Further, in the control of the pump motor 72, PWM control is performed in which the duty ratio of the pulse voltage is adjusted. Thus, when merely the duty ratio of the pulse voltage is adjusted, the revolution rate of the pump motor 72 can be adjusted. This permits simple and accurate control of the revolution rate of the pump motor 72.

Further, the adjustment of the duty ratio is performed by increasing or decreasing individually the duty ratio in the control table such that the fluctuation of the driving speed should be reduced, on the basis of the fluctuation of the load within one cycle of the bellows pump 74 measured in advance. This permits fine control of the bellows pump 74 within one cycle, and hence achieves further reduction of the fluctuation of the driving speed.

Further, in this embodiment, when the time period during which the duty ratio control using the control table is performed is shorter than one cycle in the detection of the H-signals by the CPU 91, the pump motor 72 is controlled and driven at the duty ratio of the last unit time period of the duty ratio control until when a next duty ratio control in which the correction amount $\alpha$1 is reflected begins. This avoids the situation that no voltage is applied after the termination of the duty ratio control so that the pump motor 72 does not operate. That is, the pump motor 72 can be driven reliably.

Further, in this embodiment, when the time period during which the duty ratio control using the control table is performed is longer than one cycle in the detection of the H-signals by the CPU 91, the driving control of the pump motor 72 is interrupted when the detection signal is detected again. After this interruption, the pump motor 72 is controlled and driven on the basis of a new control table corrected with the correction amount $\alpha$1. Accordingly, the situation is avoided that the time correspondence relationship between the detected period and the control table deviates from each other so that appropriate control is not achieved, which is caused by applying the duty ratio before the interruption again.

Further, in this embodiment, when the pressure exceeds a threshold value in the pressure sensor 76, the driving of the pump motor 72 is stopped. Furthermore, when the pressure moves below a threshold value in the pressure sensor 76, the driving of the pump motor 72 is restarted. This prevents the bellows pump 74 exerting an excessive pressure on the cartridge 62 and thereby causes the ink to overflow from the liquid container 41. That is, an appropriate amount of ink can be supplied from the cartridge 62 to the liquid container 41, so that an appropriate amount of ink can be stored in the liquid container 41. Further, when the pressure does not reach the predetermined value, the CPU 91 starts the driving of the pump motor 72. This allows the liquid container 41 to always store a predetermined amount of ink.

Further, the position detector 78 detects the position that the bellows pump 74 is fully expanded, and thereby transmits an H-signal. Accordingly, when the position detector 78 detects the above position of the bellows pump 74 once and then detects the above position of the bellows pump 74 again, an initial timing and a termination timing of one operation cycle of the bellows pump 74 can be measured. Thus, when the time period between these timings is measured, the operation cycle of the bellows pump 74 can be measured accurately.

In addition, in this embodiment, the position detector 78 stops the driving of the pump motor 72 when the bellows pump 74 is fully expanded. Thus, in a case where the pump motor 72 is driven at the next time, when the CPU 91 receives the first H-signal from the position detector 78, the timing directly indicates one operation cycle of the bellows pump 74. This allows the measurement of the operation cycle to be performed accurately at the initial stage of the pump driving, and hence realizes quiet operation more rapidly.

Further, in this embodiment, the correction amount $\alpha$1 and the correction amount $\alpha$3 are added starting at the third cycle of the reciprocating motion of the pump member. In this case, even when the bellows pump 74 stops in the middle of the pumping action, the time period between the detection of the first H-signal and the detection of the second H-signal (the time period of the second cycle) can be measured accurately. Thus, when the correction amounts $\alpha$1 and $\alpha$3 calculated at the second cycle are added at the third cycle, quiet operation is achieved satisfactorily in the pump unit 70.

The configuration of this embodiment can be modified in various manners. Such modifications will be described below.

In this embodiment, the position detector 78 transmits a detection signal. Then, on the basis of this detection signal, the CPU 91 calculates the operation cycle. Then, on the basis of the actually measured operation cycle, the CPU 91 calculates the correction amount $\alpha$1. However, a configuration may be adopted in which a time period of the transmission of the H-signal from the position detector 78 (that is, the time period in which the detection lever 78*a* is pushed in so that the H-signal is transmitted) is measured and in which the correction amount is calculated on the basis of the time period.

Here, the time period of the transmission of the H-signal occupies a certain ratio to the actually measured operation cycle of the bellows pump 74. Thus, in the above-mentioned configuration, when the time period of the transmission of the H-signal is measured, the operation cycle of the bellows pump 74 can be predicted. On the basis of this prediction, the correction amount can be calculated from the stage that the bellows pump 74 begins to operate so that the first H-signal is transmitted. Then, when the correction amount is added to voltage having the duty ratio, the driving speed of the pump motor 72 can approach the target driving speed from the initial stage of the driving of the bellows pump 74.

In this embodiment, the correction amount $\alpha$1 is the same regardless of the ink residual amount in the cartridge 62. However, the correction amount $\alpha$1 may be varied depending on the ink residual amount. In this case, the ink residual amount is stored in advance in a memory such as an unshown EEPROM provided in the cartridge 62. Then, this ink residual amount stored in the memory is read out. Thus, on the basis of the ink residual amount, the CPU 91 determines correction variation amount β to be added to the correction amount α1. Here, the read-out of the ink residual amount and the calculation of correction variation amount β may be performed at any stage as long as it is performed before the Step S19 of FIG. 10.

In an example of the above-mentioned cartridge 62, ink is stored in a first bag-shaped member, while the air is also flowed into a second bag-shaped member. Further, the first bag-shaped member and the second bag-shaped member are arranged adjacent to each other. In a case where this configuration is adopted, when the ink residual amount is small, the second bag-shaped member is in contact with the first bag-shaped member in a state exerting no pressure. Thus, the air is introduced easily in comparison with the case that the ink residual amount is large. In this case, the revolution rate of the pump motor 72 tends to increase, so that the problem of noise arises. Accordingly, when the ink residual amount is small, the correction variation amount p has a larger negative value than in the case of a large ink residual amount.

Then, the correction variation amount β calculated as described above is added after the correction amount α1 is calculated. Thus, a voltage having a duty ratio of the sum of the correction amount α1 and the correction variation amount β is applied to the pump motor 72, so that the pump motor 72 is driven. According to this method, the noise generated from the load parts can be suppressed regardless of the ink residual amount.

Further, in this embodiment, the voltage applied to the pump motor 72 at the first cycle and the second cycle is a fixed value stored in the ROM 92. However, in the case of a special situation, for example, that the revolution rate has a large fluctuation and is unstable at each time of startup of the printer 10, such a fixed value may be varied in correspondence with the situation that the printer 10 is started up next time. Further, the fixed value may be corrected immediately on the basis of the time that the position detector 78 transmits an H-signal within one operation cycle. That is, at startup, in a case where the time until the first H-signal is transmitted is shorter than a prescribed time period, the CPU 91 may immediately vary so as to reduce the duty ratio. Alternatively in a case where the time until the first H-signal is transmitted is longer than a prescribed time period, the CPU 91 may immediately vary so as to increase the duty ratio.

Next, a second embodiment of the invention will be described with reference to FIGS. 14 and 15. Components similar to those in the first embodiment will be designated by the same reference numerals and repetitive explanations for those will be omitted.

Figure 14:
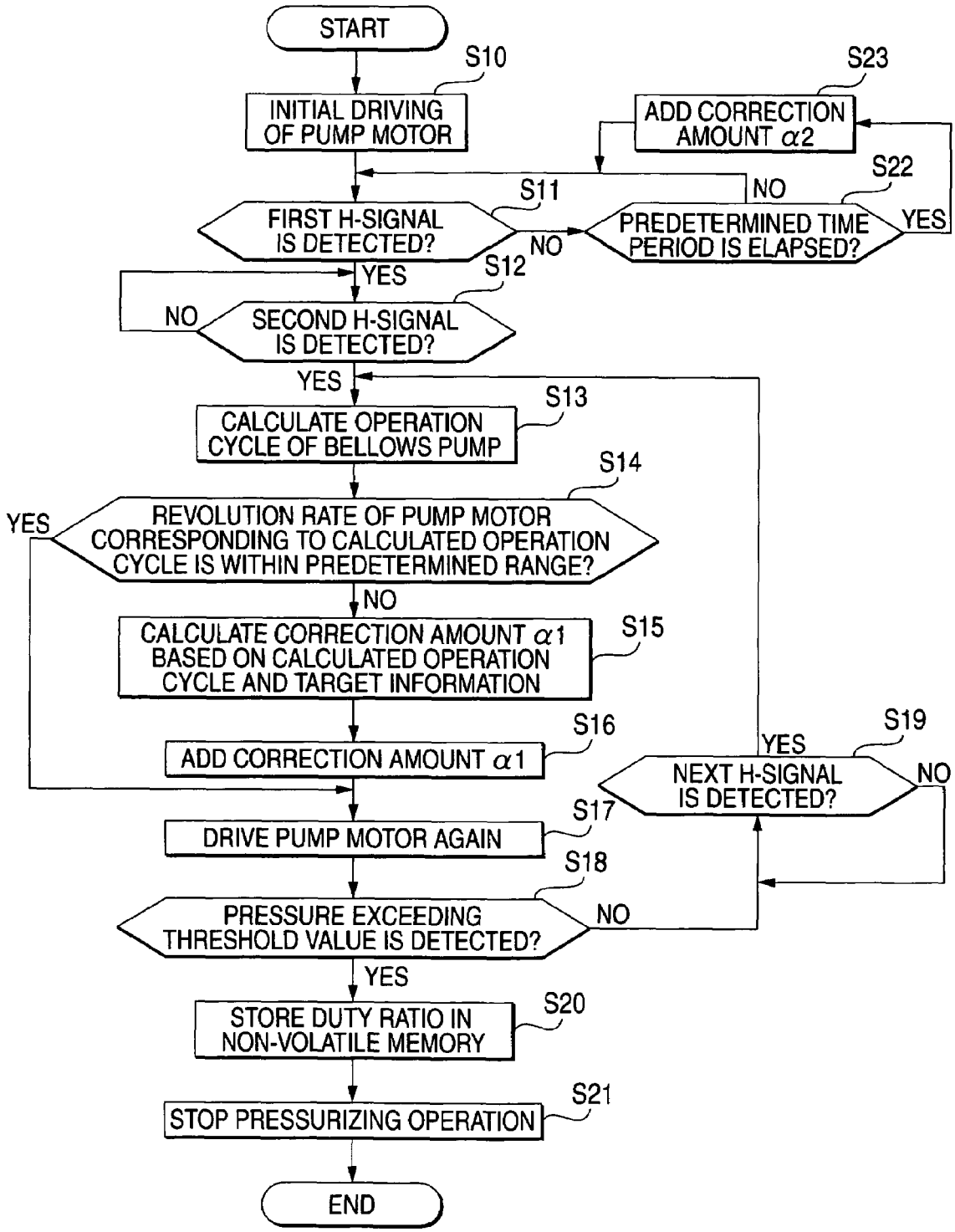
FIG. 14 is a flow chart showing how to control a pump unit according to a second embodiment of the invention, when a pump motor in the pump unit is initially driven.

In this embodiment, as shown in FIG. 14, when it is determined that no H-signal has been received (in the case of No) at Step S11, the procedure moves to Step S22.

In Step S22: when the CPU 91 determines that no first H-signal has been received, the CPU 91 determines whether a predetermined time period has elapsed or not. In this determination, when it is determined that the time period has elapsed (in the case of Yes), the procedure moves to the next Step S23. Further, when it is determined that the time period has not yet elapsed (in the case of No), the procedure returns to the above-mentioned Step S 1.

In Step S23, the CPU 91 adds a correction amount α2 to the duty ratio. That is, in some cases such as a fault (for example, when a large load is caused by ink solidification or the like), no first H-signal can be transmitted even after the signal is awaited for the predetermined time period. In this case, when the transmission of an H-signal is merely awaited, the procedure cannot move into the next cycle. Thus, when no H-signal is transmitted even after a certain time period has elapsed, the CPU 91 adds the correction amount α2 forcibly, thereby determines voltage having the duty ratio, and then applies the voltage having the corrected duty ratio to the pump motor 72.

The correction amount α2 added at Step S23 is a value for increasing the duty ratio. Thus, for example, when the bellows pump 74 cannot begin to operate because of a somewhat insufficient torque, this problem can be resolved. That is, electric power is supplied that is necessary for causing the bellows pump 74 to begin to operate. Further, after the Step S23, the procedure returns to the above-mentioned Step S11. Here, the correction amount α2 provided when the time period has elapsed may be increased stepwise within a certain limit as time progresses.

Steps S44 and S45 shown in FIG. 15 are similar to Steps S22 and S23 described above. Thus, detailed description is omitted.

According to this configuration, at the initial stage of the operation, the maximum revolution rate of the pump motor 72 can be adjusted so as not to exceed the target revolution rate of the pump motor 72. This achieves the suppression of the noise generated from the load parts such as the bellows pump 74 and the other frictional parts. That is, as described above, since the target information is set up such that the noise generated from the load parts moves outside the audible range, as the pump motor 72 operates, noise generation can be reduced on the basis of the detection in the position detector 78. That is, when the control is performed as described above, the frequency can be reduced in the noise generated from the load parts such as gear engagement/sliding portions. Thus, the frequency of the load parts that has reached the audible range in the conventional art and hence caused a noisy feeling does not reach the audible range and hence reduces remarkably the noisy feeling to users.

Further, in the printer 10, a mechanical load fluctuates owing to a change in the friction caused by long-term usage, ink viscosity, and the like, so that the initial revolution rate varies in the pump motor 72. However, even in a case where the initial revolution rate varies, when the pump motor 72 is driven merely for a few cycles, the pump motor 72 can converge to the vicinity of the target revolution rate. Further, in the printer 10, even in a case where the initial load fluctuates, the relationship between the revolution rate of the pump motor 72 and the generated noise is almost the same. Thus, when the revolution rate of the pump motor 72 is controlled appropriately, the noise generated from the mechanical parts can be reduced to a target noise level or lower.

According to this configuration, even in a case where the pump motor 72 is driven after an interval has elapsed, the maximum revolution rate of the pump motor 72 can be set near a desired revolution rate. That is, the pump motor 72 is driven in a state that the duty ratio having been adopted immediately before the interval is used and that the correction amount α3 is added to this duty ratio. Accordingly, at the stage that the driving source is initially driven after the interval, noise can be suppressed that is generated from the load parts such as the bellows pump 74 and the other frictional parts.

This permits the suppression of the noise of the load parts that has caused a noisy feeling at the initial stage after an interval in the conventional art. As such, user desire of quiet operation is satisfied.

Further, the driving of the pump motor 72 is controlled using the duty ratio, which frequently varies, adopted immediately before the interval. Here, in the printer 10, the mechanical load continues to fluctuate owing to a change in the friction caused by long-term usage, ink viscosity, and the like. However, when the duty ratio immediately before the interval is used as described above, such fluctuation of the load can be treated satisfactorily.

Further, the correction amount α3 added to the duty ratio immediately before the interval is a value for reducing the duty ratio immediately before the interval. Thus, in comparison with the case that the duty ratio is increased, quieter operation can be achieved. As such, the noise generated from the load parts can be suppressed from the initial stage after the interval.

Further, in this embodiment, when the CPU 91 determines that a predetermined time period has elapsed, the correction amount α2 is added to voltage having the duty ratio. Thus, even in the case where a certain fault (for example, when a large load is caused by ink solidification or the like), no first H-signal is transmitted even after the signal is awaited for a predetermined time period, the pump motor 72 can overcome the load and thereby begin to operate when the correction amount α2 is added so that the voltage is increased. Accordingly, the situation is avoided that when such a load acts on the pump motor 72 (the bellows pump 74), so that the pump motor 72 (the bellows pump 74) cannot begin to operate indefinitely.

Next, a third embodiment of the invention will be described with reference to FIGS. 16 and 17. Components similar to those in the second embodiment will be designated by the same reference numerals and repetitive explanations for those will be omitted.

Figure 16:
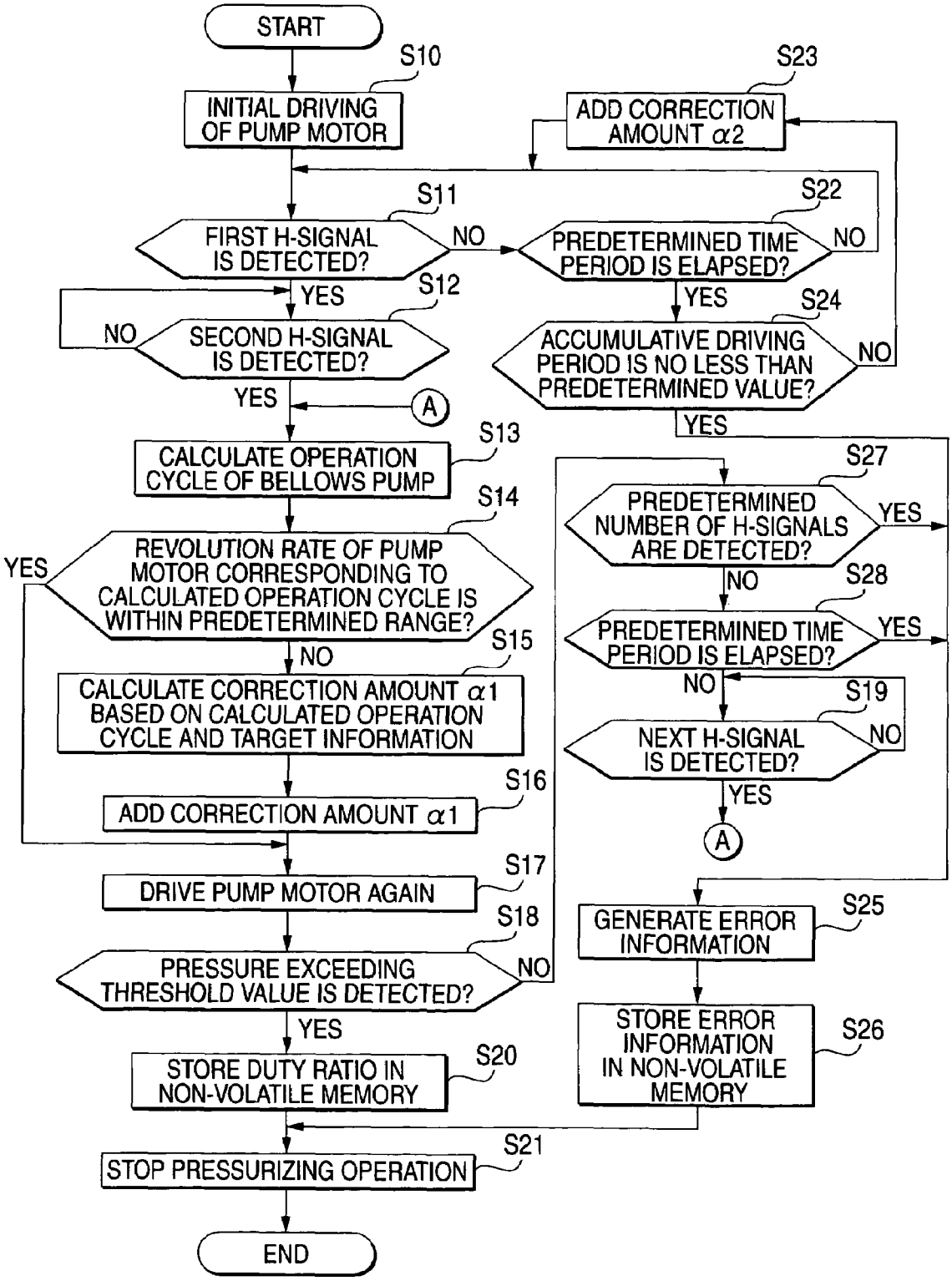
FIG. 16 is a flow chart showing how to control a pump unit according to a third embodiment of the invention, when a pump motor in the pump unit is initially driven.
Figure 17:
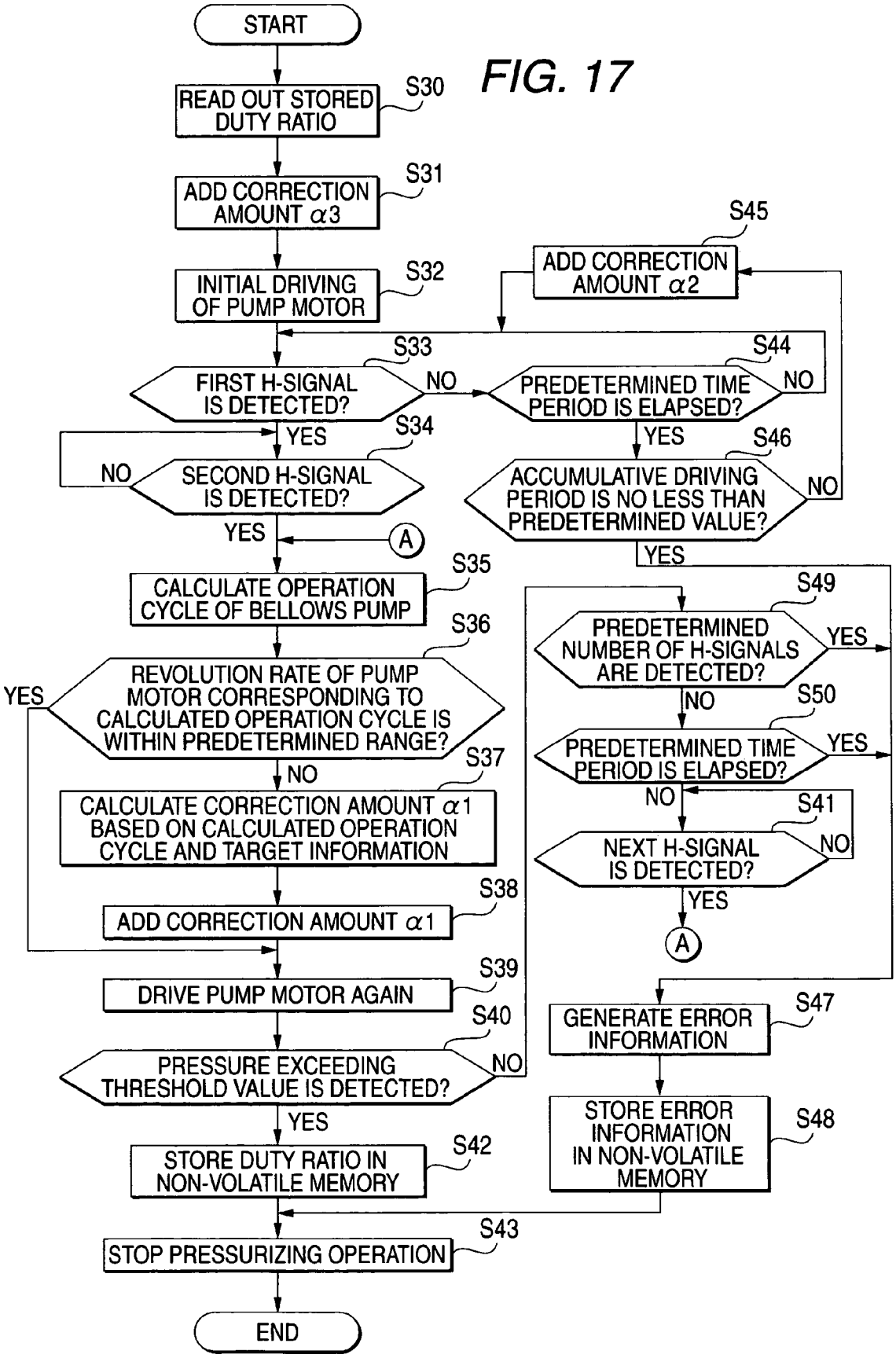
FIG. 17 is a flow chart showing how to control the pump unit of the third embodiment when the pump motor is driven after an interval.

In this embodiment, when it is determined that a predetermined time period has elapsed (in the case of Yes) in Step S22, the procedure moves to the next Step S24 as shown in FIG. 16.

In Step S24, it is then determined whether the accumulative driving time period of the pump motor 72 has reached a certain threshold value or longer. In this determination, when it is determined that the accumulative driving time period has reached the threshold value, the procedure moves to Step S25 described later. Further, when it is determined that the accumulative driving time period has not yet reached the threshold value, the procedure moves to the next Step S23.

Here, when the accumulative driving time period of the pump motor 72 reaches the threshold value, abnormality is present such as that the position detector 78 has a fault and hence cannot transmit an H-signal, and that a very large load acts on the pump motor 72 and thereby prevents the revolution. Thus, the determination at Step S24 permits the recognition of the occurrence of the above-mentioned abnormality, and hence prevents the situation that the pump motor 72 continues to operate indefinitely and thereby generates a large amount of heat.

In this embodiment, when it is determined that the pressure value does not exceed the threshold value (in the case of No) in Step S18, the CPU 91 determines whether the H-signals have been detected or not in a number of times greater than or equal to a prescribed value (a predetermined number of times or more) in Step S27. In this determination, when the H-signals have been detected in a number of times no less than the prescribed value (in the case of Yes), the procedure moves to Step S25 described later. When a number of times is detected as not reaching the prescribed value (in the case of No), the procedure moves to the next Step S28.

In Step S23, the CPU 91 determines whether the wait time for the H-signal transmitted from the pressure sensor 76 has reached or exceeded the certain threshold value or not. In this determination, when it is determined that the wait time has reached or exceeded the threshold value, the procedure moves to Step S25 described later. Further, when it is determined that the wait time has not yet exceeded the threshold value, the procedure moves to Step S19.

Here, the case that the H-signals have been detected in a number of times greater than or equal to the predetermined value at Step S22 or alternatively the case that the wait time for the H-signal transmitted from the pressure sensor 76 is determined as reaching the threshold value at Step S23 corresponds to a situation that no pressure rise is observed despite that the pump motor 72 is driven for a sufficient time. This situation can be caused by an abnormality such as that the pressure sensor 76 cannot transmit a detection signal such as the H-signal, and that a hole or the like is present in the pressure sensor 76, the air pipe 86, or the like so that air is leaking. Thus, the determination at Steps S27 and S28 permits the recognition of the above-mentioned abnormality, and hence prevents the situation that the pump motor 72 continues to operate indefinitely and thereby generates a large amount of heat.

In Step S25, when it is determined that the accumulative driving time period of the pump motor 72 has reached the threshold value in Step S24 or when the abnormality is detected at Steps S27 and S28 (in the case of Yes), the CPU 91 generates error information.

In Step S26, the error information generated at Step S25 is stored into the non-volatile memory 101. After the Step S26 has been performed, the procedure moves to Step S21. The error information is preferably displayed on an unshown display provided in the printer 10, and thereby notified to the user.

Steps after the Step S32 are similar to the Steps S11-S28 described above. Thus, similarly to the case that the above-mentioned Step S24 is present, an abnormality can be detected such as that the position detector 78 cannot transmit the H-signal, and that a very large load acts on the pump motor 72 and thereby prevents the revolution. Further, similarly to the case that the above-mentioned Steps S27 and S28 are present, an abnormality can be detected such as that the pressure sensor 76 cannot transmit a detection signal such as the H-signal, and that a hole or the like is present in the pressure sensor 76, the air pipe 86, or the like, so that air is leaking. In FIG. 17, Steps S11-S28 correspond to Steps S33-S50, respectively. Thus, detailed description thereof is omitted.

According to this embodiment, when the accumulative driving time period of the pump motor 72 has reached or exceeded a certain value in a state that the position detector 78 does not detect a detection signal, the CPU 91 stops the driving of the pump motor 72. This avoids a trouble that when the position detector 78 has a certain fault and hence cannot transmit a position detection signal, the pump motor 72 continues to operate. This prevents that the pump motor 72 continues to operate so that the amount of heat generation becomes large and thereby damages the pump motor 72. Further, since the pump motor 72 does not continue to operate, the situation is avoided that the noise continues in association with the operation.

Further, at Step S22, it is determined whether the waiting time period for the H-signal from the position detector 78 has reached or exceeded a certain value or not. Then, only in the case of Yes at Step S22, it is determined whether the accumulative driving time period has not yet reached a certain threshold value or not at Step S24. Then, at Step S24, when the accumulative driving time period has not yet reached a certain threshold value (in the case of No), the correction amount α2 is added to voltage having the duty ratio. Thus, even in a case where because of a certain fault (for example, when a large load is caused by ink solidification or the like), no first H-signal is transmitted even after the signal is awaited for a predetermined time, the pump motor 72 can overcome the load and thereby begin to operate when the correction amount α2 is added so that the voltage is increased. This avoids the situation that when such a load acts on the pump motor 72 (the bellows pump 74), the pump motor 72 (the bellows pump 74) cannot begin to operate indefinitely. Once the pump motor 72 begins to operate, the detection signal can be received from the position detector 78.

Further, at Step S24, when the accumulative driving time period has reached a certain threshold value, the driving of the pump motor 72 is stopped. This avoids the situation that when no H-signal is received from the position detector 78 the pump motor 72 continues to operate. Accordingly, the problem is avoided that the adding of the correction amount α2 continues and thereby excessively increases voltage having the duty ratio applied to the pump motor 72 so that the heat generation from the pump motor 72 increases. This avoids the problem that the pump motor 72 is damaged by the heat generation.

Further, in a state that the pressure sensor 76 does not transmit an H-signal, when the H-signals have been detected from the position detector 78 in a number of times greater than or equal to a predetermined value as at Step S27, the driving of the pump motor 72 is stopped. Thus, even in a case where no H-signal is detected from the pressure sensor 76 owing to a certain fault such as that a hole is present in the bellows pump 74, the pump motor 72 can be stopped when the number of times of detection of the H-signals has reached or exceeded the predetermined number of times. This avoids a trouble that the pump motor 72 continues to operate indefinitely so that the user continues to wait for a long time. Further, a trouble is avoided that the pump motor 72 continues to operate indefinitely so that the pump motor 72 is damaged by heat generation. Further, since the pump motor 72 does not continue to operate, the situation is avoided that the noise continues in association with the operation.

Further, even in a case where the pressure sensor 76 does not transmit an H-signal and that the detection signals from the position detector 78 at Step S27 have not yet reached a predetermined number of times, the driving of the pump motor 72 is stopped when the accumulative driving time period of the pump motor 72 has reached or exceeded a certain value. Thus, similarly to Step S22, a trouble is avoided that the pump motor 72 continues to operate indefinitely so that the user continues to wait for a long time. Further, a trouble is avoided that the pump motor 72 continues to operate indefinitely so that the pump motor 72 is damaged by heat generation. Further, since the pump motor 72 does not continue to operate, the situation is avoided that the noise continues in association with the operation.

Further, when the error information generated at Step S25 is displayed on the unshown display, the user can bring the apparatus to a service center or the like on the basis of error information, so that repair work or the like can be performed.

Further, the error information is stored into the non-volatile memory 101. Thus, when the non-volatile memory 101 is read later, the occurrence of a fault in the pressure sensor 76 or the position detector 78 can be recognized. This permits the narrowing down of a fault portion in the repair work or the like, and hence reduces the time and effort in the repair work.

In this embodiment, the accumulative driving time period of the pump motor 72 is used as the determining condition at Step S24. However, the duty ratio may be used as the determining condition. For example, in a case where the Step S23 is performed by feedback with a fixed interval so that the correction amount α2 is added periodically. In this case, at Step S24, it is determined whether the duty ratio has exceeded a certain threshold value or not. In the case of Yes in this determination, an abnormal voltage value is concluded so that error information is generated at Step S25. According to this method, voltage having the duty ratio can be used as the wait condition.

Further, in this embodiment, in a case where the pressure becomes slightly below the threshold value of the pressure sensor 76 in a state that the printer 10 is in operation, the driving speed of the pump motor 72 may be controlled into a much lower speed in comparison with the case that the power of the printer 10 is activated. According to this method, much quieter operation is achieved in the printer 10. In this case, even when the driving speed of the pump motor 72 is controlled into the much lower speed, the air pressure is merely slightly below the threshold value. Thus, when the bellows pump 74 reciprocates a several times, the air pressure immediately exceeds the threshold value. Accordingly, even when the much lower speed is realized, a problem does not arise that an excessive time is necessary until the air pressure exceeds the threshold value.

The above-mentioned embodiments have been described for the case that a DC motor is used as the pump motor 72. However, the pump motor 72 is not limited to a DC motor. For example, the invention can be applied to a drive mechanism using an AC motor or the like as long as it is controllable by the PWM technique.

The above-mentioned embodiments have been described for the case that ink is used as the liquid and that the cartridge 62 is used as the liquid supply source while the liquid container 41 is used. However, the liquid is not limited to the ink, and may be a treatment liquid, a cleaning liquid, or the like used in various processings for semiconductors or the like. In these cases, the liquid supply source is composed of a tank for storing the treatment liquid or the cleaning liquid, in place of the cartridge 62.

Further, in the above-mentioned embodiments, when the pressure measured by the pressure sensor 76 exceeds the threshold value, the driving of the pump motor 72 is stopped. However, in place of the pressure sensor 76, a sensor for detecting the amount of ink may be provided on the liquid container 41 side. Then, when the sensor has sensed that the amount of ink is sufficient, the CPU 91 may stop the driving of the pump motor 72.

Further, the above-mentioned embodiments have been described for the case that the pump control mechanism is applied to the home-use printer 10. However, the pump control mechanism of the invention is not limited to the application to the printer 10, and may be applied to a business-use large-sized printer. Further, the invention may be applied to a device other than a printer, for example, to a compressor of an air-conditioner.

In the above-mentioned embodiments, the drive information contains: each cycle; the revolution rate at each cycle; and voltage having the duty ratio at each cycle. Further, the target information contains: each cycle serving as the target of the pump motor 72; and the revolution rate at that cycle. However, the drive information/target information are not limited to these. For example, the flow rate of the ink may be used as the drive information/target information.

Further, the above-mentioned embodiments have been described for the case that the correction is performed by adding the correction amounts α1 to α3 (including the case that a negative value is added). However, in a case where the correction amounts α1 to α3 are predetermined correction coefficients, the correction coefficients may be multiplied to the duty ratio. Further, the control information, the correction information, the corrected control information, the second correction information, and the like are not limited to the case that a fixed numerical value is added. These kinds of information may be those that change the control timing performed in the control program.

What is claimed is:

1. A pump control mechanism, comprising:

a pump unit, comprising:

a pump member, adapted to be cyclically moved to apply an air pressure to a liquid supply source to thereby supply liquid stored therein to a reservoir member; and a driving source, configured to be driven in accordance with control information to move the pump member;

a position sensor, sensing a position of the pump member;

a first storage, storing target information indicative of a target driving speed of the driving source;

a first calculator, operable to obtain drive information indicative of an actual driving speed of the driving source based on the sensed position of the pump member;

a second calculator, operable to obtain a difference between the target driving speed and the actual driving speed, and obtain first correction information for reducing the difference; and a corrector, operable to correct the control information with the first correction information, wherein:

the driving source is driven by a voltage signal having a pulse waveform; and the control information includes a duty ratio of the voltage signal in connection with a pulse width modulation technique, and the first correction information includes data for varying the duty ratio.

2. The pump driving mechanism as set forth in claim 1, further comprising a timer, counting a time period until the position sensor detects that the pump member is moved to a prescribed position, wherein the corrector corrects the control information so as to increase the duty ratio when the time period reaches a prescribed value.

3. The pump control mechanism as set forth in claim 1, further comprising:

a duty ratio monitor, monitoring the duty ratio of the voltage signal; and a controller, operable to deactivate the driving source for a prescribed time period when the monitored duty ratio exceeds a prescribed value.

4. A printer incorporating the pump control mechanism as set forth in claim 1, comprising;

a carriage, adapted to move in a prescribed direction; and a recording head, mounted on the carriage and adapted to perform printing on a printing medium, wherein;

the liquid is ink; and the liquid supply source is a replaceable cartridge storing the ink.

5. A pump control mechanism comprising;

a pump unit, comprising;

a bellows pump, adapted to be cyclically moved to apply an air pressure to a liquid supply source to thereby supply liquid stored therein to a reservoir member; and a driving source, configured to be driven in accordance with control information to move the bellows pump;

a position sensor, sensing a position of the bellows pump;

a first storage, storing target information indicative of a target driving speed of the driving source;

a first calculator, operable to obtain drive information indicative of an actual driving speed of the driving source based on the sensed position of the bellows pump;

a second calculator, operable to obtain a difference between the target driving speed and the actual driving speed, and obtain first correction information for reducing the difference;

a corrector, operable to correct the control information with the first correction information;

a pressure sensor, sensing the air pressure; and a controller, operable to activate or deactivate the driving source in accordance with the air pressure sensed by the pressure sensor, wherein the controller deactivates the driving source so that the bellows pump is stopped at a position that the bellows pump is fully expanded.

6. A printer incorporating the pump control mechanism as set forth in claim 5, comprising:

a carriage, adapted to move in a prescribed direction; and a recording head, mounted on the carriage and adapted to perform printing on a printing medium, wherein;

the liquid is ink; and the liquid supply source is a replaceable cartridge storing the ink.

7. A pump control mechanism comprising:

a pump unit, comprising:

a pump member, adapted to be cyclically moved to apply an air pressure to a liquid supply source to thereby supply liquid stored therein to a reservoir member; and a driving source, configured to be driven in accordance with control information to move the pump member;

a position sensor, sensing a position of the pump member;

a first storage, storing target information indicative of a target driving speed of the driving source;

a first calculator, operable to obtain drive information indicative of an actual driving speed of the driving source based on the sensed position of the pump member;

a second calculator, operable to obtain a difference between the target driving speed and the actual driving speed, and obtain first correction information for reducing the difference;

a corrector, operable to correct the control information with the first correction information; and a second storage storing the corrected control information, wherein:

the driving source is driven based on the corrected control information stored in the second storage when the driving source is reactivated;

the driving source is driven by a voltage signal having a pulse waveform; and the control information includes a duty ratio of the voltage signal in connection with a pulse width modulation technique, and the first correction information includes data for varying the duty ratio.

8. The pump control mechanism as set forth in claim 7, wherein the corrector corrects the corrected control information with second correction information when the driving source is reactivated.

9. The pump control mechanism as set forth in claim 8, wherein the second correction information includes data for decreasing the duty ratio.

10. A printer incorporating the pump control mechanism as set forth in claim 7, comprising:

a carriage, adapted to move in a prescribed direction; and a recording head, mounted on the carriage and adapted to perform printing on a printing medium, wherein;

the liquid is ink; and the liquid supply source is a replaceable cartridge storing the ink.

11. A pump control mechanism comprising:

a pump unit, comprising:

a pump member, adapted to be cyclically moved to apply an air pressure to a liquid supply source to thereby supply liquid stored therein to a reservoir member; and a driving source, configured to be driven in accordance with control information to move the pump member;

a position sensor, sensing a position of the pump member;

a first storage, storing target information indicative of a target driving speed of the driving source;

a first calculator, operable to obtain drive information indicative of an actual driving speed of the driving source based on the senses position of the pump member;

a second calculator, operable to obtain a difference between the target driving speed and the actual driving speed, and obtain first correction information for reducing the difference; and a corrector, operable to correct the control information with the first correction information, wherein:

the control information includes a control table in which data for increasing or decreasing a driving force of the driving source from a reference value in accordance with load acting on the driving source is set for each of a plurality of unit time periods;

the driving source is driven by a voltage signal having a pulse waveform;

the control table includes data for increasing or decreasing a duty ratio of the voltage signal, in connection with a pulse width modulation technique, from a reference value for each of the unit time periods; and the first correction information includes data for varying the duty ratio.

12. A printer incorporating the pump control mechanism as set forth in claim 11, comprising:

a carriage, adapted to move in a prescribed direction; and a recording head, mounted on the carriage and adapted to perform printing on a printing medium, wherein;

the liquid is ink; and the liquid supply source is a replaceable cartridge storing the ink.

13. A pump control mechanism, comprising:

a pump unit, comprising:

a pump member, adapted to be cyclically moved to apply an air pressure to a liquid supply source to thereby supply liquid stored therein to a reservoir member; and a driving source, configured to be driven in accordance with control information to move the pump member;

a position sensor, sensing a position of the pump member;

a first storage, storing target information indicative of a target driving speed of the driving source;

a first calculator, operable to obtain drive information indicative of an actual driving speed of the driving source based on the sensed position of the pump member;

a second calculator, operable to obtain a difference between the target driving speed and the actual driving speed, and obtain first correction information for reducing the difference; and a corrector, operable to correct the control information with the first correction information, wherein:

the control information includes a control table in which data for increasing or decreasing a driving force of the driving source from a reference value in accordance with load acting on the driving source is set for each of a plurality of unit time periods;

a total length of the unit time periods is shorter than one cycle of the movement of the pump member; and the driving source is driven with the data of a final one of the unit time periods until the control information is corrected with the first correction information in a next cycle of the movement of the pump member.

14. A printer incorporating the pump control mechanism as set forth in claim 13, comprising:

a carriage, adapted to move in a prescribed direction; and a recording head, mounted on the carriage and adapted to perform printing on a printing medium, wherein;

the liquid is ink; and the liquid supply source is a replaceable cartridge storing the ink.

15. A pump control mechanism, comprising;

a pump unit, comprising;

a pump member, adapted to be cyclically moved to apply an air pressure to a liquid supply source to thereby supply liquid stored therein to a reservoir member; and a driving source, configured to be driven in accordance with control information to move the pump member;

a position sensor, sensing a position of the pump member;

a first storage, storing target information indicative of a target driving speed of the driving source;

a first calculator, operable to obtain drive information indicative of an actual driving speed of the driving source based on the sensed position of the pump member;

a second calculator, operable to obtain a difference between the target driving speed and the actual driving speed, and obtain first correction information for reducing the difference; and a corrector, operable to correct the control information with the first correction information, wherein:

the control information includes a control table in which data for increasing or decreasing a driving force of the driving source from a reference value in accordance with load acting on the driving source is set for each of a plurality of unit time periods;

a total length of the unit time periods is longer than one cycle of the movement of the pump member; and the application of the control information to the driving source in one cycle of the movement of the pump member is interrupted when the position sensor detects a prescribed position of the pump member for a next cycle.

16. A printer incorporating the pump control mechanism as set forth in claim 15, comprising:

a carriage, adapted to move in a prescribed direction; and a recording head, mounted on the carriage and adapted to perform printing on a printing medium, wherein;

the liquid is ink; and the liquid supply source is a replaceable cartridge storing the ink.

* * * * *

UNITED STATES PATENT AND TRADEMARK OFFICE

CERTIFICATE OF CORRECTION

PATENT NO. : 7,607,750 B2
APPLICATION NO. : 11/237992
DATED : October 27, 2009
INVENTOR(S) : Igarashi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 836 days.

Signed and Sealed this

Twelfth Day of October, 2010

David J. Kappos

David J. Kappos
*Director of the United States Patent and Trademark Office*